US012551745B2

(12) United States Patent
Garcia

(10) Patent No.: US 12,551,745 B2
(45) Date of Patent: Feb. 17, 2026

(54) BARBELL

(71) Applicant: Coulter Ventures, LLC., Columbus, OH (US)

(72) Inventor: Nicolas Garcia, Centerburg, OH (US)

(73) Assignee: Coulter Ventures, LLC., Columbus, OH (US)

( * ) Notice: Subject to any disclaimer, the term of this patent is extended or adjusted under 35 U.S.C. 154(b) by 130 days.

(21) Appl. No.: 18/077,871

(22) Filed: Dec. 8, 2022

(65) Prior Publication Data

US 2023/0173325 A1 Jun. 8, 2023

Related U.S. Application Data

(60) Provisional application No. 63/287,406, filed on Dec. 8, 2021.

(51) Int. Cl.
*A63B 21/072* (2006.01)
*A63B 71/00* (2006.01)

(52) U.S. Cl.
CPC .. *A63B 21/0724* (2013.01); *A63B 2071/0063* (2013.01)

(58) Field of Classification Search
CPC ..... A63B 21/0724; A63B 21/0728; A63B 21/4049; A63B 2071/0063
See application file for complete search history.

(56) References Cited

U.S. PATENT DOCUMENTS 2,470,815 A 5/1949 Harvey
4,455,020 A 6/1984 Schnell
4,697,937 A 10/1987 Karlsson et al.
4,893,810 A 1/1990 Lee
5,839,996 A 11/1998 Gooding
D430,482 S 9/2000 Stout, Jr.
6,770,016 B1 * 8/2004 Anderson ..... A63B 21/0724 482/106

(Continued)

FOREIGN PATENT DOCUMENTS

EP 0235366 B1 5/1989

OTHER PUBLICATIONS

ND Pell-it®—Pre-Applied Self-Locking Nylon Insert; product listing downloaded Dec. 6, 2022; 7 pages; https://www.ndindustries.com/products/inert-threadlocking/nd-pell-it/.

(Continued)

*Primary Examiner* — Joshua Lee
(74) *Attorney, Agent, or Firm* — Banner & Witcoff, Ltd.

(57) ABSTRACT

A barbell includes a bar, a first sleeve assembly having a first sleeve with a first proximal bore portion, a first distal bore portion, and a first central bore portion extending therebetween. An inner proximal bushing is received in the first proximal bore portion, a proximal bearing received in the first proximal bore portion and having two sets of roller bodies positioned between inner and outer races. An outer proximal bushing is received in the first proximal bore portion. The outer proximal bushing engages the first sleeve and the outer race. The outer surface of the inner race has a first annular channel receiving the first set of roller bodies and a second annular channel receiving the second set of roller bodies, and the inner surface of the outer race has a concavely curved annular channel receiving both sets of roller bodies.

23 Claims, 20 Drawing Sheets

(56) References Cited

U.S. PATENT DOCUMENTS

| | | | | |
|---|---|---|---|---|
| D583,883 | S | 12/2008 | Thomas | |
| 8,617,036 | B2 * | 12/2013 | Chen | A63B 21/0728 482/106 |
| 8,672,815 | B1 | 3/2014 | Springer | |
| 8,986,174 | B2 * | 3/2015 | Lien | A63B 21/4049 482/106 |
| 9,314,661 | B1 | 4/2016 | Chen | |
| 9,522,298 | B2 | 12/2016 | Siemer | |
| 9,550,091 | B2 | 1/2017 | Emerson | |
| 9,623,276 | B1 | 4/2017 | Deras | |
| D788,886 | S | 6/2017 | Salzer | |
| 9,925,406 | B2 | 3/2018 | Brown | |
| D843,524 | S | 3/2019 | Henniger | |
| D862,617 | S | 10/2019 | Henniger et al. | |
| D873,356 | S | 1/2020 | Henniger et al. | |
| D954,161 | S | 6/2022 | Ameri | |
| 11,497,955 | B2 | 11/2022 | Garcia | |
| D980,926 | S | 3/2023 | Ameri et al. | |
| D1,042,674 | S | 9/2024 | Henniger et al. | |
| D1,042,675 | S | 9/2024 | Henniger et al. | |
| 12,138,502 | B2 | 11/2024 | Garcia | |
| 2006/0276314 | A1 | 12/2006 | Wilson et al. | |
| 2009/0192025 | A1 | 7/2009 | Minerva | |
| 2011/0021327 | A1 | 1/2011 | Lien | |
| 2012/0094810 | A1 | 4/2012 | Anderson | |
| 2013/0109545 | A1 * | 5/2013 | Chen | A63B 21/0724 482/107 |
| 2013/0165300 | A1 | 6/2013 | Richards | |
| 2014/0045660 | A1 | 2/2014 | Murray et al. | |
| 2014/0045661 | A1 * | 2/2014 | Lien | A63B 21/4049 29/456 |
| 2014/0162850 | A1 * | 6/2014 | Chen | A63B 21/0728 482/104 |
| 2014/0274595 | A1 * | 9/2014 | Patti | A63B 21/0724 482/106 |
| 2015/0038302 | A1 * | 2/2015 | O'Brien | A63B 21/0724 482/107 |
| 2015/0343255 | A1 | 12/2015 | Miller et al. | |
| 2017/0216654 | A1 | 8/2017 | Parker et al. | |
| 2017/0319894 | A1 | 11/2017 | Ernst | |
| 2019/0184223 | A1 | 6/2019 | Seitzer | |
| 2019/0217147 | A1 * | 7/2019 | Garcia | A63B 21/0724 |
| 2021/0001164 | A1 | 1/2021 | Garcia et al. | |
| 2021/0178214 | A1 | 6/2021 | Garcia | |
| 2022/0161096 | A1 | 5/2022 | Berg | |
| 2023/0173325 | A1 | 6/2023 | Garcia | |

OTHER PUBLICATIONS 2206-2RS-TVH Self Alighing Ball Bearing; product listing; 3 pages download Dec. 8, 2022;https://medias.schaeffler.us/en/product/rotary/rolling-and-plain-bearings/ball-bearings/self-aligning-ball-bearings/2206-2rs-tvh/p/365996.

22206-E1-XL; Spherical Roller Bearing; product listing; 3 pages; downloaded Dec. 8, 2022; https://medias.schaeffler.us/en/product/rotary/rolling-and-plain-bearings/roller-bearings/spherical-roller-bearings/spherical-roller-bearings/22206-e1-xl/p/387854.

3203-BD-XL-2HRS-TVH; Angular Contact Ball Bearing; product listing; 3 pages; downloaded Dec. 8, 2022; https://medias.schaeffler.us/en/product/rotary/rolling-and-plain-bearings/ball-bearings/angular-contact-ball-bearings/3203-bd-xl-2hrs-tvh/p/360568.

NAS & MS Fasteners, Stocked or Made to Order, product listing; 6 pages; downloaded https://www.ndindustries.com/products/nd-nas-ms-fasteners/.

May 8, 2023—(WO) ISR and WO—App PCT/US2022/081200.

Jul. 17, 2024 (EP) Rules 161(2) and 162 EPC Communication—App 22905379.8.

May 16, 2025—(AU) Office Action—App 2022407529.

Product listing for American Barbell Cerakote Training Bar from https://web.archive.org/web/20170224030649/http://americanbarbell.com/products/american-barbell-cerakote-training-bar, dated Feb. 24, 2017.

Screen images from https://web.archive.org/web/20170224030649/http://americanbarbell.com/products/american-barbell-cerakote-training-bar, dated Feb. 24, 2017.

Product listing for Rogue The Ohio Bar—Cerakote from https://www.roguefitness.com/the-ohio-bar-cerakote with irrelevant material redacted, dated Feb. 15, 2019, product known to be available prior to Apr. 23, 2018, but not on or prior to Apr. 23, 2017.

Olympic WI Bar by Rogue dated 4/18/201. Found online [Apr. 18, 2019] https://www.roguefitness.com/rogue-olympic-wl-bar-cerakote?bvstate=pg:/ct:r (Year:2014).

Pyros Bar by Rogue dated no date given. Found online [Apr. 18, 2019] https://www.roguefitness.com/rogue-pyrros-bar-25mm (Year:0).

Training Bar by Rogue dated Apr. 18, 2014. Found online [Apr. 18, 2019] https://roguefitness.com/rogue-28mm-training-bar? bvstate=pg:2/ct:r (Year: 2014).

Performance Training Bar by American Barbell dated Dec. 14, 2014. Found online [Apr. 18, 2019] https://americanbarbell.com/products/american-barbell-performance-training-bar (Year: 2014).

Performance Bearing Bar by American Barbell dated Dec. 17, 2014. Found online [Apr. 18, 2019] https://americanbarbell.com/products/american-barbell-performance-bearing-bar (Year: 2014).

29MM Boneyard Bars by Rogue dated no date given. Found online [Apr. 18, 2019] https://www.roguefitness.com/rogue-28mm-boneyard-bars (Year: 0).

Ohio Power Bar by Rogue dated Apr. 18, 2014. Found online [Apr. 18, 2019] https://www.roguefitness.com/rogue-ohio-power-bar?bvstate=p. 11/ct:r (Year: 2014).

IWF by Eleiko dated no date given. Found online [Apr. 18, 2019] https://www.eleiko.com/en/p/eleiko-iwf-weightlifting-training-bar-20-kg-men/14#gs.5oncat (Year: 0).

Vulcan by Vulcan dated no date given. Found online [Apr. 18, 2019] https://www.vulcanstrength.com/Men-s-professional-Olympic-Bar-p/vstb-m.htm (Year: 0).

Westside power bar 2 by Rogue dated Apr. 18, 2016. Found online [Apr. 18, 2019] https://www.roguefitness.com/rogue-westside-power-bar-2-0?bvstate=pg:2/ct:r (Year: 2016).

Grizzly Power Bar by American Barbell dated Dec. 13, 2017. Found online [Apr. 18, 2019] https://americanbarbell.com/products/grizzly-power-bar (Year: 2014).

Power Bar by American Barbell dated Mar. 18, 2015. Found online [Apr. 18, 2019] https://americanbarbell.com/products/american-barbell-power-bar (Year: 2015).

Mammoth Bar by American barbell dated Sep. 23, 2015. Found online [Apr. 18, 2019] https://americanbarbell.com/products/american-barbell-ceramic-mammoth-bar (Year: 2015).

Rogue Loadable Dumbbells by Rogue dated Mar. 23, 2017. Found online [Mar. 23, 2020] https://www.roguefitness.com/rogue-loadable-dumbbells?bvstate=pg:3/ct:r.

Product listing for Rogue Freedom Bar from http://web.archive.org/web/20180704014252/https://www.roguefitness.com/cerakote-28-5-mm-freedom-bar, dated Jul. 4, 2018, accessed May 5, 2021.

Product listing for Rogue Echo Bar from http://web.archive.org/web/20151120213400/https://www.roguefitness.com/rogue-echo-bar, dated Nov. 20, 2015, accessed May 5, 2021.

Product listing for Rogue Echo Bar 2.0 from http://web.archive.org/web/20180731224007/https://www.roguefitness.com/rogue-echo-bar, dated Jul. 31, 2018, accessed May 7, 2021.

Producting listing for Rogue Castro Bar—Bare Steel Barbell from http://web.archive.org/web/20140613135148/https://www.roguefitness.com/the-castro-bar tness.com/the-castro-bar, dated Jun. 13, 2014, accessed May 5, 2021.

Product listing for Rogue Operator Bar 3.0; From: http://web.archive.org/web/20210225082909/https://www.roguefitness.com/rogue-operator-bar-cerakote; dated Jul. 23, 2018, accessed Jun. 29, 2021.

Product listing for Rogue 10KG Junior Bar; From: http://web.archive.org/web/20180720234027/https://www.roguefitness.com/rogue-10kg-junior-bar; dated Jun. 13, 2015, accessed Jun. 29, 2021.

The Rogue Bar 2.0 by Rogue dated Aug. 4, 2014. Found online [Aug. 4, 2017] https://www.roguefitness.com/the-rogue-bar-2-0.

Yaheetech, announced 2015 [online], [site visited Jul. 8, 2022]. Available on internet, URL:https://www.amazon.com/Yaheetech-Olympic-Collars-Workout-Exercises/dp/B0172TDYK4/ref (Year: 2015).

(56) References Cited

OTHER PUBLICATIONS

Sunny, announced 2010 [online], [site visited Jul. 8, 2022]. Available on internet, URL:https://www.amazon.com/Sunny-Threaded-Chrome-Barbell-60-Inch/dp/B004EFYPBC/ref (Year: 2010).
Archon, announced 2018 [online], [site visited Jul. 8, 2022]. Available on internet, URL:https://www.amazon.com/ARCHON-Womens-Oylmpic-Needle-Bearing/dp/B07D3XR88X/ref (Year: 2018).
Rage fitness store, announced 2014 [online], [site visited Jul. 8, 2022]. Available on internet, URL:https://www.amazon.com/Fitness-Olympic-Training-Barbell-Weightlifting/dp/B00R93GJ74/ref (Year: 2014).
Overview of materials for Polytetrafluoroethylene (PTFE), Extruded, retrieved Dec. 3, 2021, Matweb (Year: 2021).
Resin English Definition and Meaning, retrieved Dec. 27, 2021, Lexico (Year: 2021).
Nov. 18, 2025—(EP) Rule 164(1) Communication—App 22905379.8.

* cited by examiner

BARBELL

CROSS-REFERENCE TO RELATED APPLICATION

This application is a nonprovisional of, and claims priority to, U.S. Provisional Application No. 63/287,406, filed Dec. 8, 2021, which prior application is incorporated by reference herein.

FIELD OF THE INVENTION

This disclosure relates to barbells, and more specifically to a barbell having bearings and other structures between a bar and sleeves of the barbell that are configured to reduce floating and increase smoothness of spin for the sleeves.

BACKGROUND

Barbells often undergo a great deal of shock and stress during use, particularly when used for competitive lifts such as a snatch and clean and jerk, where the barbell is dropped from an elevated position while heavily loaded. These impacts can cause damage to the bar, the sleeves, and any bearings, bushings, or other friction-reducing structures, as well as causing significant noise. Additionally, it is desirable for the barbell sleeves to rotate freely, smoothly, and consistently with respect to the bar. Many commercially available barbells suffer from deficiencies in some or all of these areas.

The present disclosure is provided to address this need and other needs in existing barbells, as well as loadable dumbbells and similar articles. A full discussion of the features and advantages of the present invention is deferred to the following detailed description, which proceeds with reference to the accompanying drawings.

BRIEF SUMMARY

Aspects of the disclosure relate to a barbell including a bar having a first end portion and a second end portion, and a first sleeve assembly having a first sleeve having a first axial bore with a first proximal bore portion, a first distal bore portion, and a first central bore portion extending between the first proximal bore portion and the first distal bore portion, wherein the first end portion of the bar is received through the first axial bore and extends through the first proximal bore portion and the first central bore portion to the first distal bore portion. The barbell also includes an inner proximal bushing received in the first proximal bore portion of the first sleeve, where the inner proximal bushing has an inner surface engaging the bar and an outer surface opposite the inner surface, a proximal bearing received in the first proximal bore portion and having an inner race engaging the inner proximal bushing, an outer race positioned outward of the inner race, and a first set of roller bodies and a second set of roller bodies engaged between an outer surface of the inner race and an inner surface of the outer race, and an outer proximal bushing received in the first proximal bore portion of the first sleeve, wherein the outer proximal bushing has an outer surface engaging the first sleeve and an inner surface engaging the outer race of the proximal bearing. The outer surface of the inner race has a first annular channel receiving the first set of roller bodies and a second annular channel receiving the second set of roller bodies, and the inner surface of the outer race has a concavely curved annular channel receiving both the first and second sets of roller bodies.

According to one aspect, the inner proximal bushing has a first lip extending outward and engaging a proximal end of the proximal bearing and a second lip extending outward and engaging a distal end of the proximal bearing.

According to another aspect, the outer proximal bushing includes a lip extending radially inward from the outer proximal bushing and received between a distal end of the proximal bearing and a distal end of the first proximal bore portion.

According to a further aspect, the barbell includes a proximal end cap having a first annular groove in a radially outer surface thereof and a resilient O-ring received within the first annular groove. The proximal end cap is received within the first annular groove and engages an inner surface of the first proximal bore portion to cover a proximal opening of the first proximal bore portion. In one configuration, the inner surface of the first proximal bore portion has a second annular groove, and the resilient O-ring is received in the second annular groove to retain the proximal end cap within the first proximal bore portion.

According to yet another aspect, the first set of roller bodies and the second set of roller bodies are balls, such that the proximal bearing is a ball bearing.

According to a still further aspect, the outer proximal bushing and the inner proximal bushing are made from a polymer material.

Additional aspects of the disclosure relate to a barbell including a bar having a first end portion and a second end portion, and a first sleeve assembly having a first sleeve having a first axial bore with a first proximal bore portion, a first distal bore portion, and a first central bore portion extending between the first proximal bore portion and the first distal bore portion, where the first end portion of the bar is received through the first axial bore and extends through the first proximal bore portion and the first central bore portion to the first distal bore portion. A distal bearing is received in the first distal bore portion and has an inner race engaging the first end portion of the bar, an outer race positioned outward of the inner race, and a plurality of roller bodies engaged between the inner race and the outer race. A fastener is positioned in the first distal bore portion and engages the first end portion of the bar and the inner race of the distal bearing to retain the distal bearing in connection with the bar. A distal bushing is received in the first distal bore portion of the first sleeve, and the distal bushing has an outer surface engaging the first sleeve and an inner surface engaging the outer race of the distal bearing. A retainer is positioned in the first distal bore portion and engages the first sleeve and the outer race of the distal bearing to retain the distal bearing in connection with the first sleeve.

According to one aspect, the distal bushing includes a lip extending radially inward from the distal bushing and received between a front side of the distal bearing and a proximal end of the first distal bore portion.

According to another aspect, the retainer threadably engages an inner surface of the first distal bore portion. For example, the retainer may be a collar nut threadably engaging the inner surface of the first distal bore portion, and the first end portion of the bar passes through the collar nut.

According to a further aspect, the first end portion of the bar includes a projection extending outwardly at a distal end of the bar, where the inner race of the distal bearing engages the projection, and the fastener threadably engages the projection.

According to yet another aspect, the retainer is formed of a metallic material and includes a polymeric annular bumper on a front surface thereof to engage the outer race of the distal bushing.

According to a further aspect, the barbell includes an end cap having an end cap base with a proximal portion received within the first distal bore portion of the first sleeve and a distal portion extending out of the sleeve and forming a portion of an exterior radial surface of the barbell, the distal portion having a recess, and an end cap plate received within the recess.

Further aspects of the disclosure relate to a barbell including a bar having a first end portion and a second end portion, and a first sleeve assembly having a first sleeve having a first axial bore with a first proximal bore portion, a first distal bore portion, and a first central bore portion extending between the first proximal bore portion and the first distal bore portion, where the first end portion of the bar is received through the first axial bore and extends through the first proximal bore portion and the first central bore portion to the first distal bore portion. A distal bearing is received in the first distal bore portion and has an inner race engaging the first end portion of the bar, an outer race positioned outward of the inner race, and a plurality of roller bodies engaged between the inner race and the outer race. The barbell also has an end cap having an end cap base with a proximal portion received within the first distal bore portion of the first sleeve and threadably engaged with an inner surface of the first distal bore portion, and a distal portion extending out of the sleeve and forming a portion of an exterior radial surface of the barbell. The distal portion having a recess, and an end cap plate received within the recess.

According to one aspect, the recess in the end cap base is a circular recess, and the end cap plate is a circular plate.

According to another aspect, the barbell includes a fastener extending axially with respect to the bar through the end cap plate to connect the end cap plate to the end cap base.

According to a further aspect, the barbell includes a distal bushing received in the first distal bore portion of the first sleeve, where the distal bushing has an outer surface engaging the first sleeve and an inner surface engaging the outer race of the distal bearing, and a retainer positioned in the first distal bore portion and engaging the first sleeve and the outer race of the distal bearing to retain the distal bearing in connection with the first sleeve, where the retainer is positioned between the end cap and the distal bearing.

According to yet another aspect, the distal portion has a larger diameter than the proximal portion and extends radially outward relative to the proximal portion.

According to a still further aspect, an outer radial surface of the distal portion of the end cap base is flush with an outer radial surface of the first sleeve and is positioned at a distal end of the first sleeve.

Other features and advantages of the disclosure will be apparent from the following description taken in conjunction with the attached drawings.

BRIEF DESCRIPTION OF THE DRAWINGS

To allow for a more full understanding of the present disclosure, it will now be described by way of example, with reference to the accompanying drawings in which.

DETAILED DESCRIPTION

Figure 1:
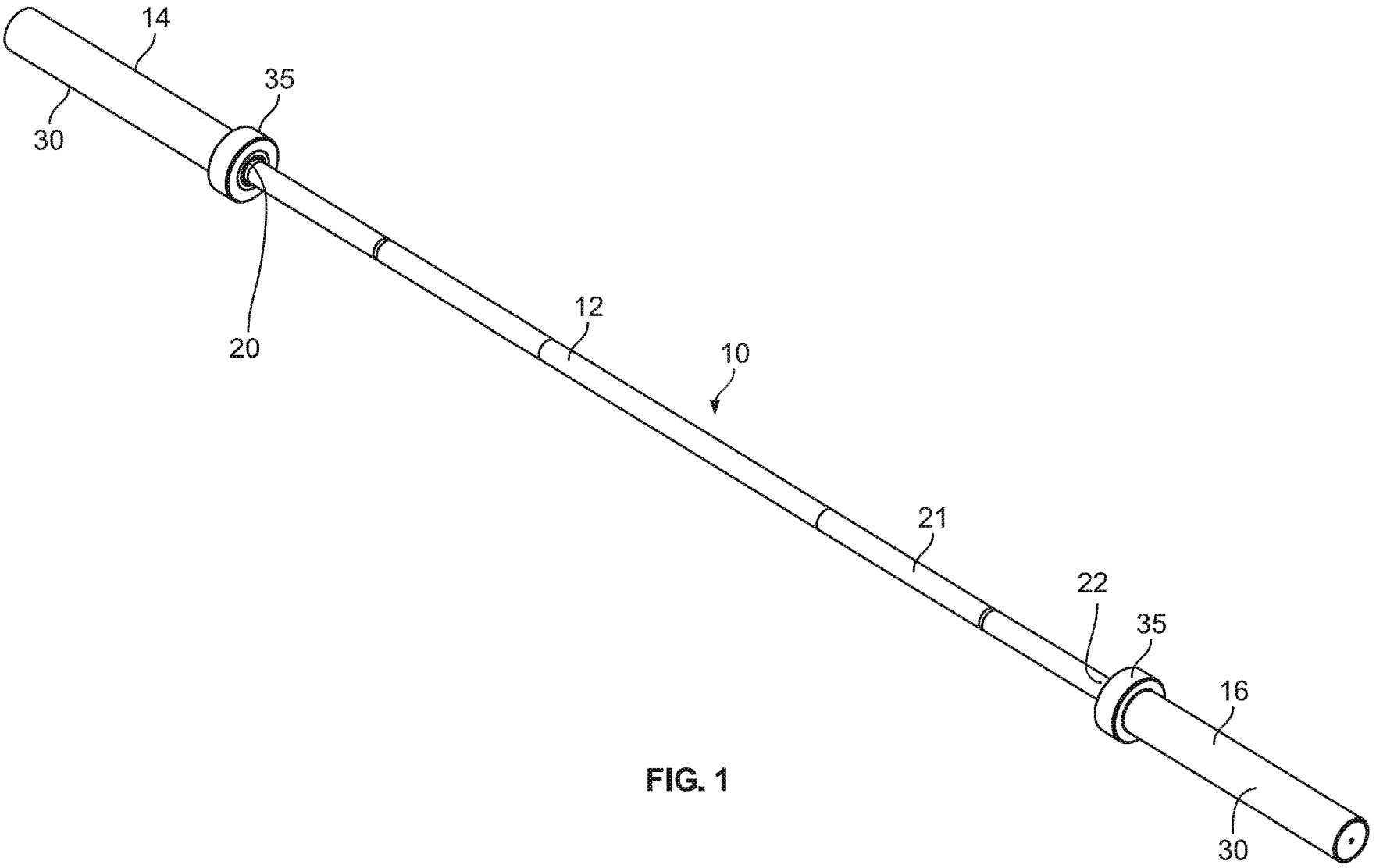
FIG. 1 is a perspective view of one embodiment of a barbell according to aspects of the present disclosure.
Figure 2:
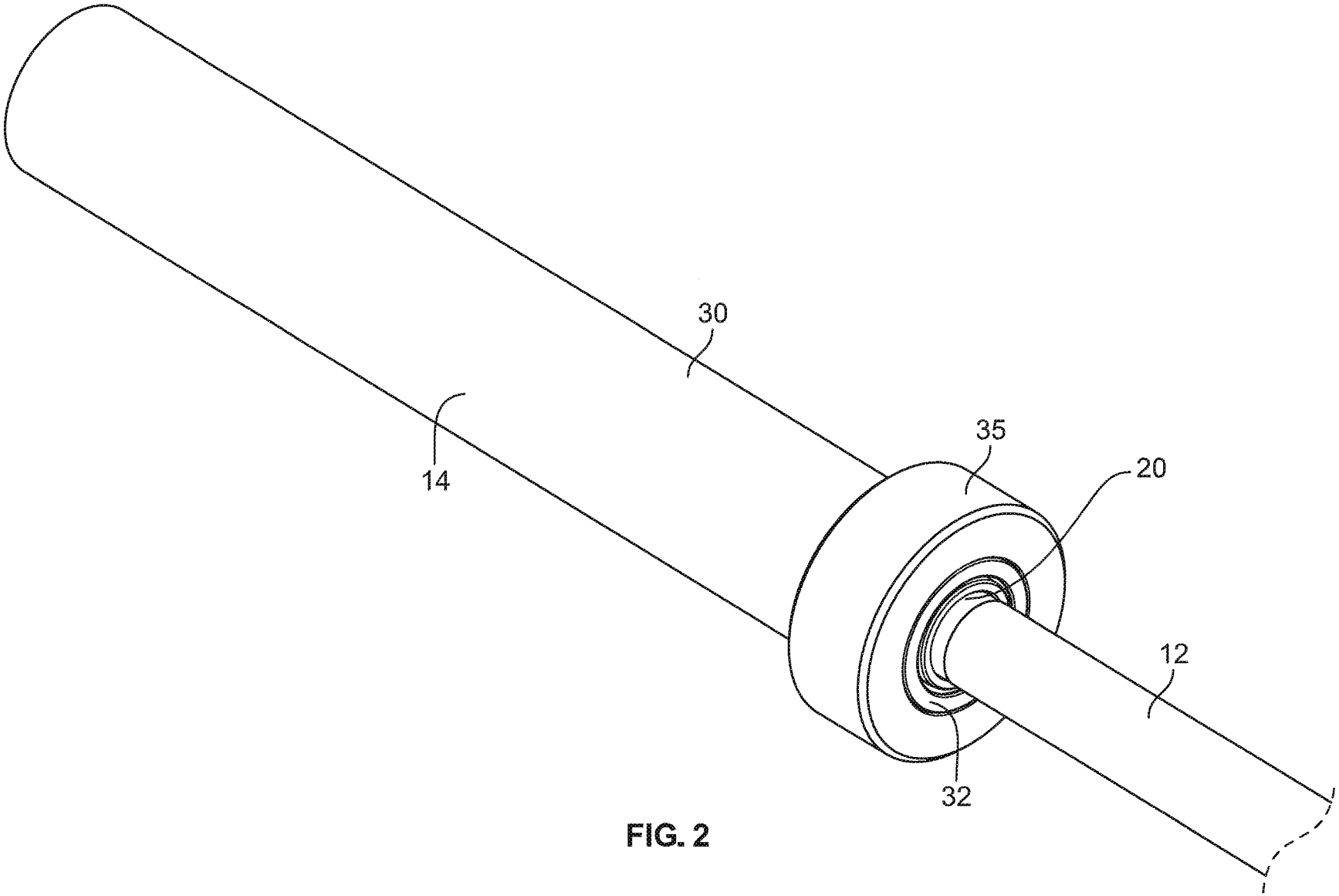
FIG. 2 is a perspective view of a first sleeve assembly of the barbell of FIG. 1.
Figure 3:
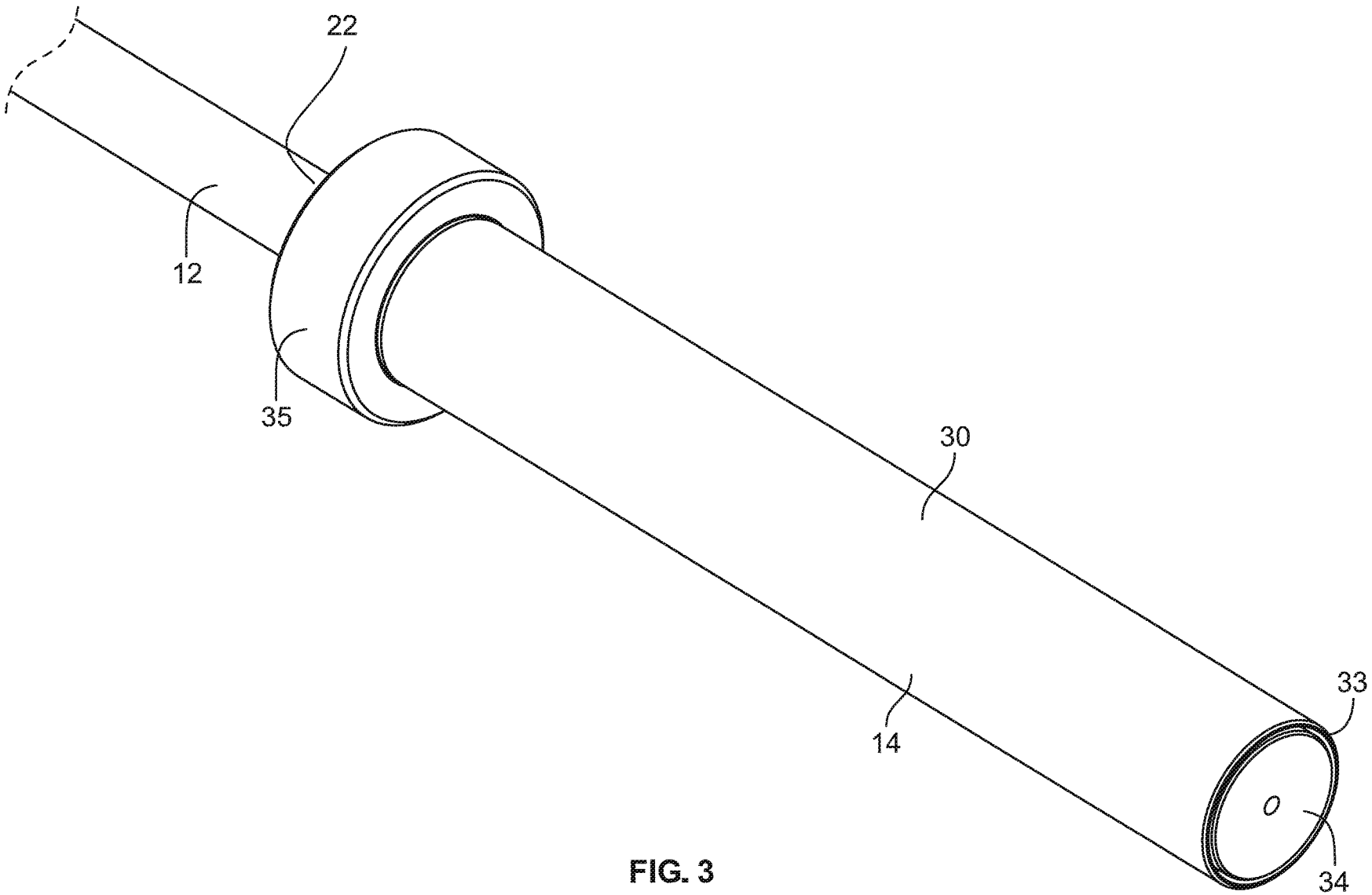
FIG. 3 is a perspective view of the first sleeve assembly of the barbell of FIG. 1.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

General aspects of the present disclosure relate to a barbell that includes structures for reducing noise and vibration when the barbell is dropped from an elevated position. FIGS. 1-10 illustrate one example embodiment of a barbell 10 according to aspects of the disclosure that includes a bar or bar member 12 having two opposed end portions 20, 22 with first and second sleeve assemblies 14, 16 positioned at the opposed end portions 20, 22 of the bar 12. The sleeve assemblies 14, 16 each include a sleeve or sleeve member 30 configured to hold one or more weights (not shown), such as weight plates having a center hole configured to receive a portion of the sleeve 30 therethrough. Removable barbell collars (not shown) or other retaining devices may also be mounted on the sleeve assemblies 14, 16 to hold the weight (s) in place. The barbell 12 also includes a connection assembly 18 that connects the bar 12 to the sleeve assemblies 14, 16. As used in this application: the term "axial" refers to the direction along the elongated length of the bar 12; the term "radial" refers to any direction perpendicular to the axial direction, e.g., along any radius of a cross-section of the bar 12 taken perpendicular to the axial direction; and the terms "proximal" and "distal" are relative terms referring to structures located toward the center of the bar 12 (proximal) or toward the ends of the bar 12 (distal), respectively, in the axial direction. These terms are intended for illustrative purposes only and do not limit the embodiments in any way.

The bar 12 has end portions 20, 22 that are connected to the sleeve assemblies 14, 16 and are received within the sleeves 30 of the sleeve assemblies 14, 16, as described in greater detail herein, and a center portion 21 extending between the sleeve assemblies 14, 16. The bar 12 is configured for connection of fasteners 61 or other retaining members to the end portions 20, 22, and the bar 12 in FIGS. 1-10 has cylindrical posts or projections 23 extending axially outward from the end portions 20, 22 at the distal ends 24 of the bar 12. Each of the projections 23 in this embodiment has at least a portion that is threaded and configured for connection to a threaded fastener 61, as shown in FIGS. 4, 7, 8, and 10, but the projections 23 may have different connecting structure for connection to a different type of fastener or other retaining member (e.g., a retaining ring, a snap ring, a pin, a clip, etc.) in another embodiment. In a further embodiment, the fastener 61 may be a male fastener, such as a bolt, that extends into a female receiver on the bar 12 for connection, and the bar 12 may not include projections 23 in this configuration. The projections 23 in FIGS. 1-10 are illustrated as being cylindrical with a circular outer periphery, but may have a different peripheral shape in another embodiment. The bar 12 is generally formed of metal, and in the embodiment of FIGS. 1-10, the bar 12 is formed of a single piece of steel.

The center portion 21 and the end portions 20, 22 of the bar 12 in this embodiment have a circular cross-section shape and a substantially constant diameter and cross-sectional area over the entire combined axial length of the center portion 21 and the end portions 20, 22. It is understood that the projections 23 in FIGS. 1-10 have a smaller diameter and cross-sectional area, and in one embodiment, the projections 23 may have a non-circular peripheral shape. The center portion 21 may further include structures to enhance gripping of the bar 12, such as knurling (not shown), and the bar 12 may be configured with or without knurling at the centermost portion of the bar 12. The end portions 20, 22 of the bar 12 in one embodiment have smooth outer surfaces to reduce friction on the outer surface. While the bar 12 is illustrated as a straight cylindrical member, it is understood that portions of the bar 12 may not be straight and/or cylindrical. For example, the bar 12 may include curves or bends or more complicated gripping structure, such as for use as a curl bar, a tricep bar, a deadlift bar, etc.

FIGS. 2-10 illustrate the connection of the sleeve assemblies 14, 16 to the bar 12 using the connection assembly 18. It is noted that FIGS. 2-10 illustrate only one of the sleeve assemblies 14 and the associated portions of the bar 12 and connection assembly 18, with the understanding that the other sleeve assembly 16 is constructed in a similar or identical manner in this embodiment. Each of the sleeve assemblies 14, 16 includes a sleeve 30 having an axial bore 31 with proximal and distal openings 32, 33 and a removable end cap 34 configured to cover the distal opening 33 of the sleeve 30. The bore 31 of each sleeve 30 is configured to receive one of the end portions 20, 22 of the bar 12 therein, such that each end portion 20, 22 enters the bore 31 of the respective sleeve 30 through the proximal opening 32. Each sleeve assembly 14, 16 also includes a collar 35 positioned at the proximal end of the sleeve 30. The collar 35 has a larger width/diameter than the outer surface of the sleeve 30, so the collar 35 can act as a stop to prevent any weights mounted on the sleeve 30 from sliding off of the sleeve 30 and onto the bar 12. In the embodiment of FIGS. 1-10, the collar 35 is integrally connected to the sleeve 30 and provided as a single piece with the sleeve 30. However, in another embodiment, the collar 35 may be separately connected to the sleeve 30 and/or the bar 12. The sleeve 30 and the collar 35 are generally formed of metal, and in FIGS. 1-10, these parts are formed as a single piece of steel. The inner surface 36 of each sleeve 30 has a circumferentially positioned annular abutment surface formed by a ridge 69 with a smaller width/diameter than the distal opening 33, such that the end cap 34 is inserted into the bore 31 through the distal opening 33 and abuts the abutment surface. Each end cap 34 is a plate member formed of stamped steel.

In the embodiment of FIGS. 1-10, the minimum inner diameter of the bore 31 is defined by a central portion 42 of the bore 31 that extends over a majority of the axial length of the sleeve 30. The minimum inner diameter of the passage 30 is greater than the maximum outer diameter of the end portions 20, 22 of the bar 12, such that the end portions 20, 22 of the bar 12 are received in the passages 31 of the sleeve 30 without contacting the inner surface 36 at any point. The connection assembly 18 includes bushings and/or other spacing structures spacing the end portions 20, 22 of the bar from the inner surface 36 of the sleeve 30, and the inner surface 36 of the sleeve 30 includes structures for engaging components of the connection assembly 18. Each connection assembly 18 includes at least a proximal bearing assembly 50 engaging the sleeve 30 and the bar 12 at or proximate to the proximal opening 32 of the bore 31, a distal bearing assembly 70 engaging the sleeve 30 and the bar 12 at or proximate the distal end 24 of the bar 12, and a spacer in the form of a spacer ring 60 engaging the distal bearing assembly 70 and spacing the distal bearing assembly 70 from the distal opening 33 of the sleeve 30. The spacer ring 60 may be configured as a spacer having a plate-like or other non-annular configuration in another embodiment, although the annular configuration of the spacer ring 60 permits access to the fastener 61 and other internal components. All of these components of the connection assembly 18 are partially or entirely received in the bore 31 of the sleeve 30. In another embodiment, either or both of the proximal bearing assembly 50 and the distal bushing assembly 70 may be replaced by a bushing or a bushing/bearing combination.

Figure 4:
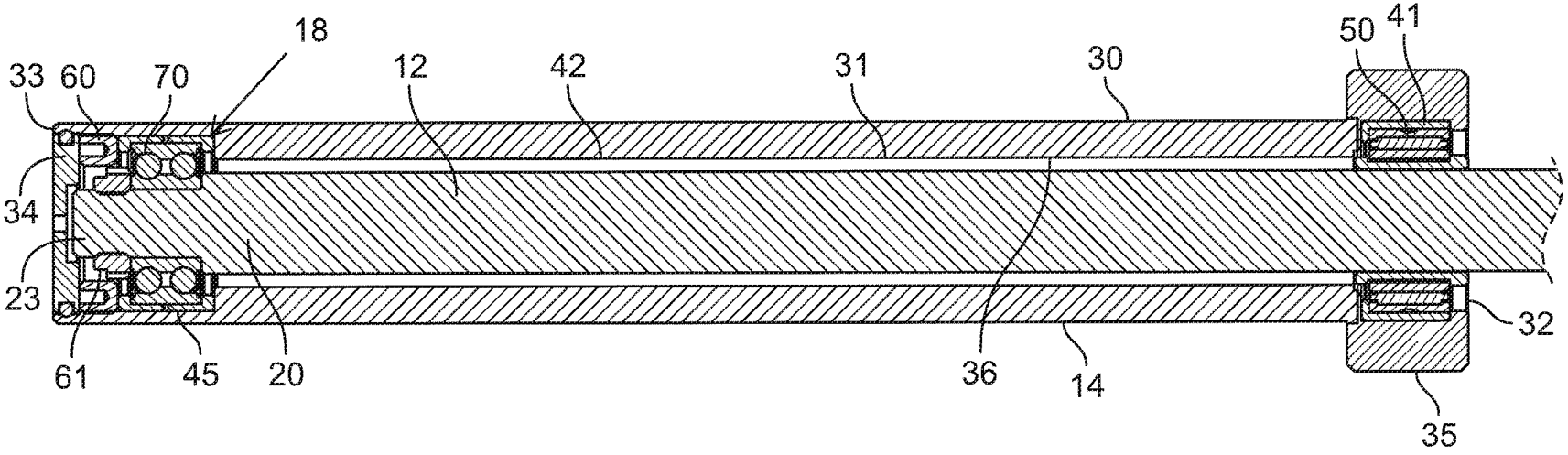
FIG. 4 is a cross-section view of the first sleeve assembly of the barbell of FIG. 1.
Figure 5:
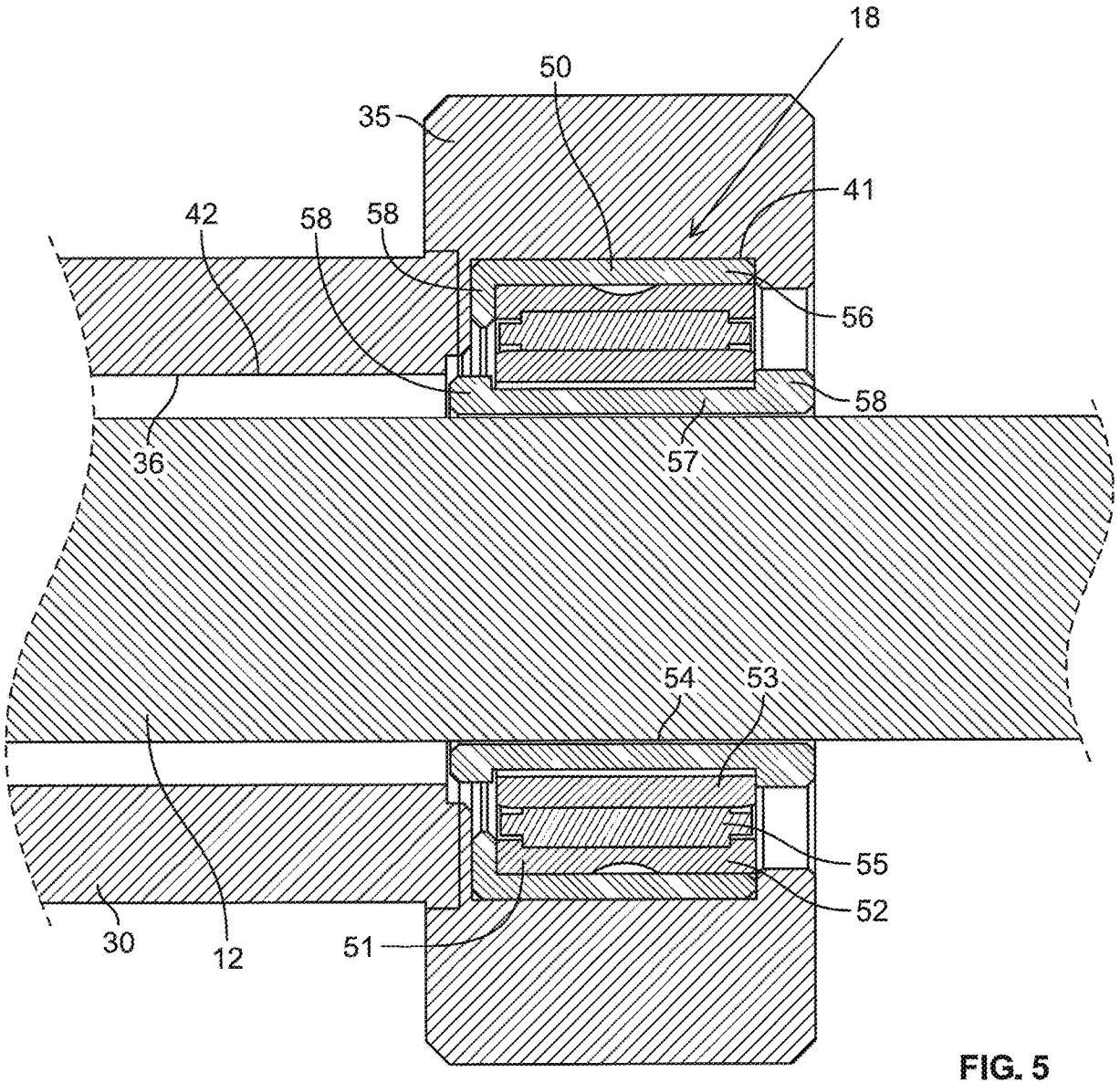
FIG. 5 is a magnified cross-section view of a portion of the first sleeve assembly of the barbell of FIG. 1.
Figure 6:
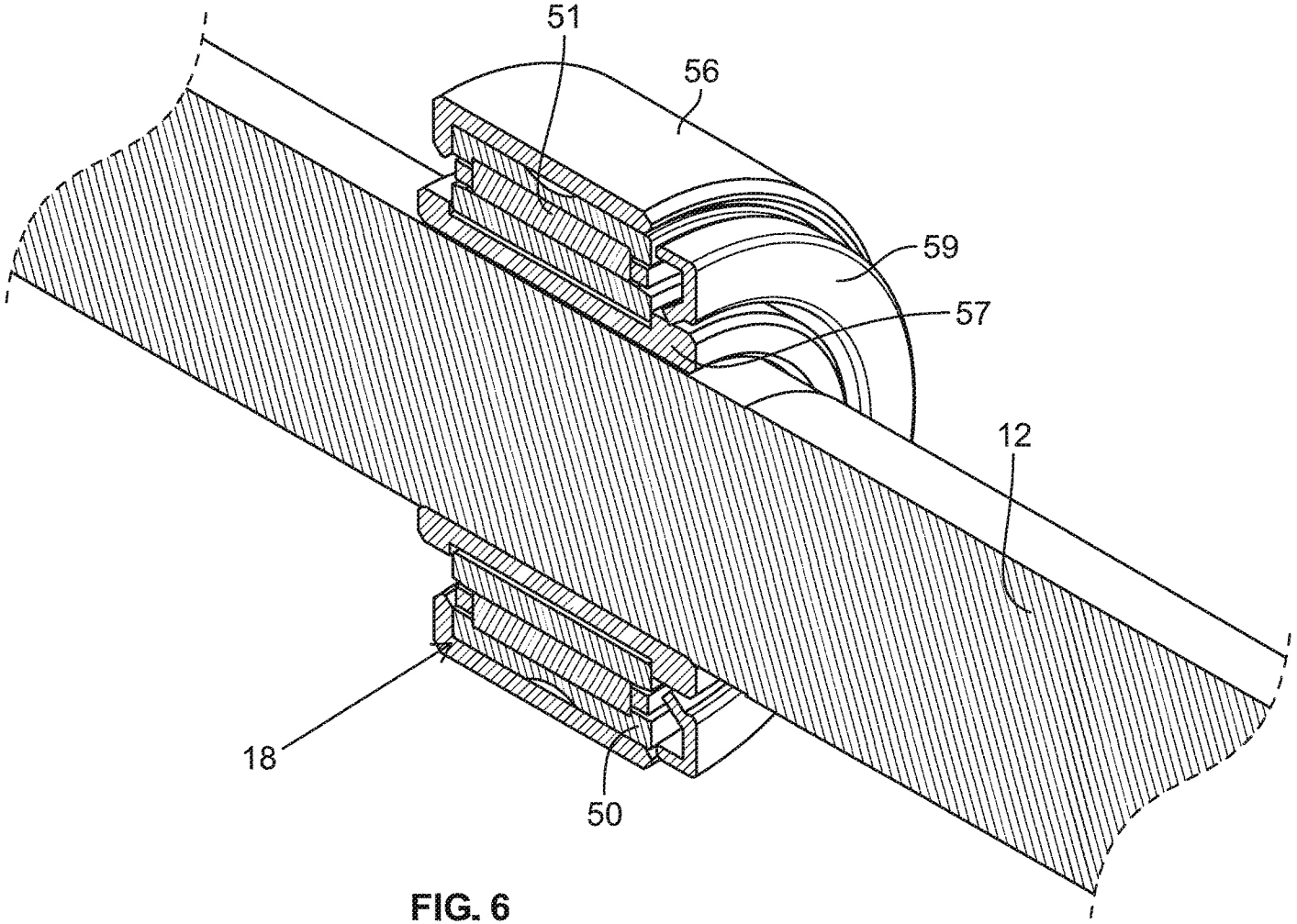
FIG. 6 is a perspective cross-section view of a proximal bearing assembly of the first sleeve assembly shown in FIG. 5.
Figure 7:
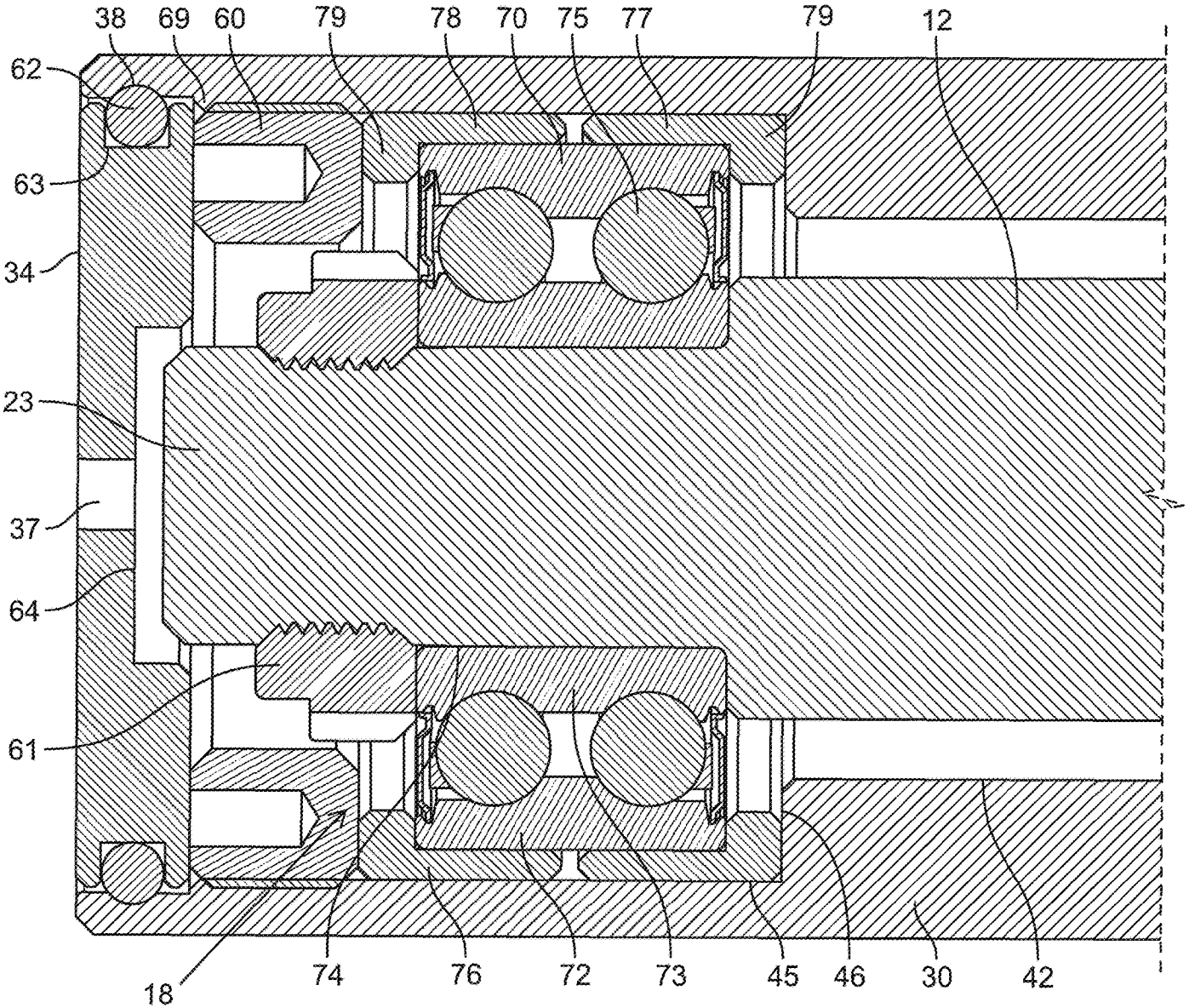
FIG. 7 is a magnified cross-section view of an end portion of the first sleeve assembly of FIG. 5.
Figure 8:
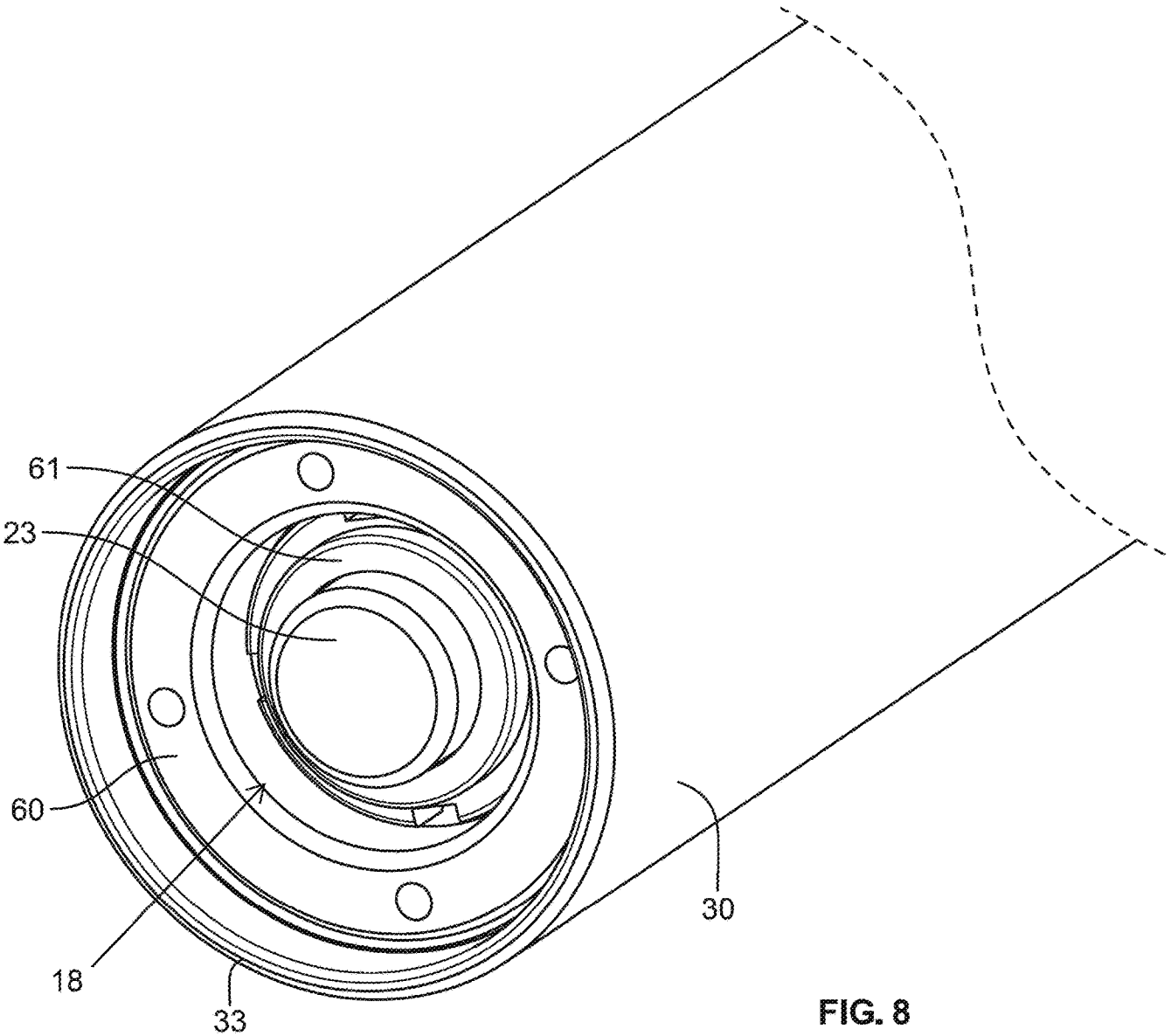
FIG. 8 is a perspective view of the portion of the first sleeve assembly shown in FIG. 7, with an end cap removed to show internal detail.
Figure 9:
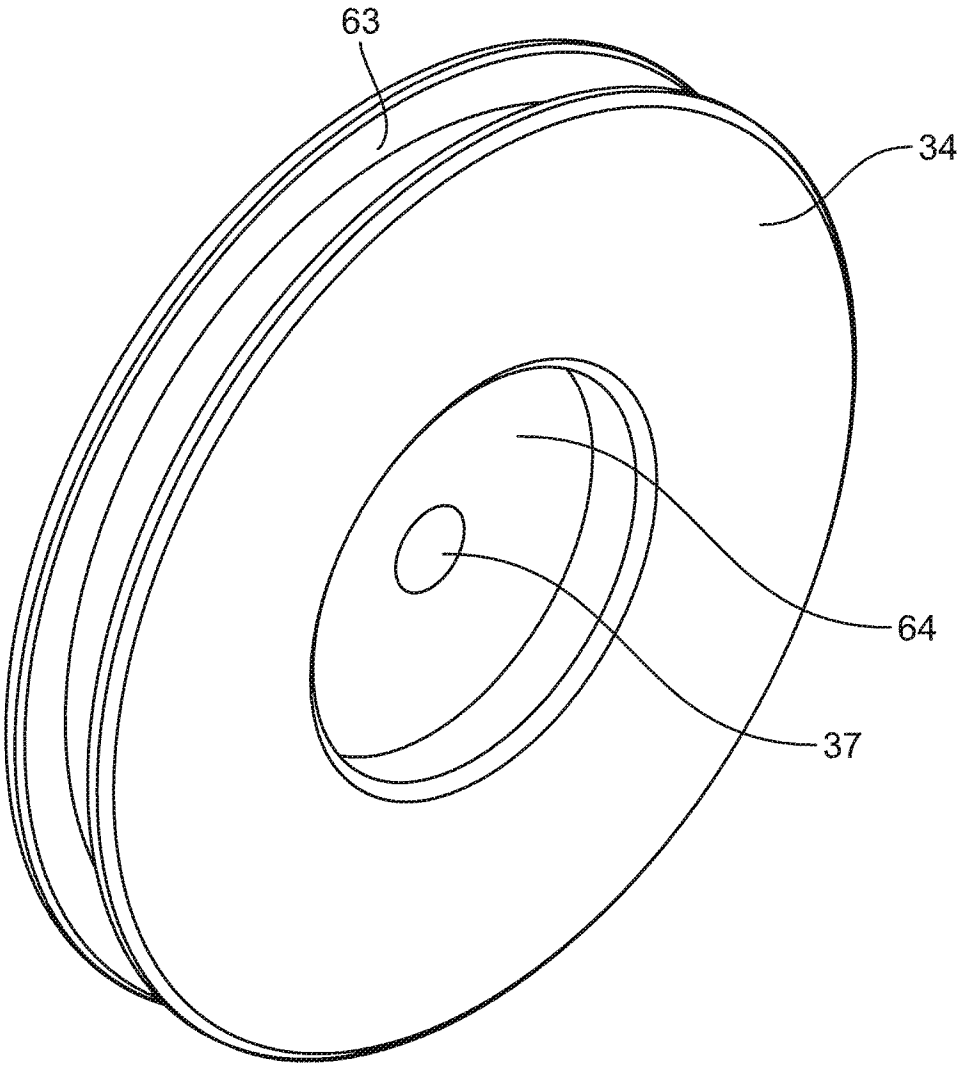
FIG. 9 is a perspective view of the end cap of the first sleeve assembly shown in FIG. 4.
Figure 10:
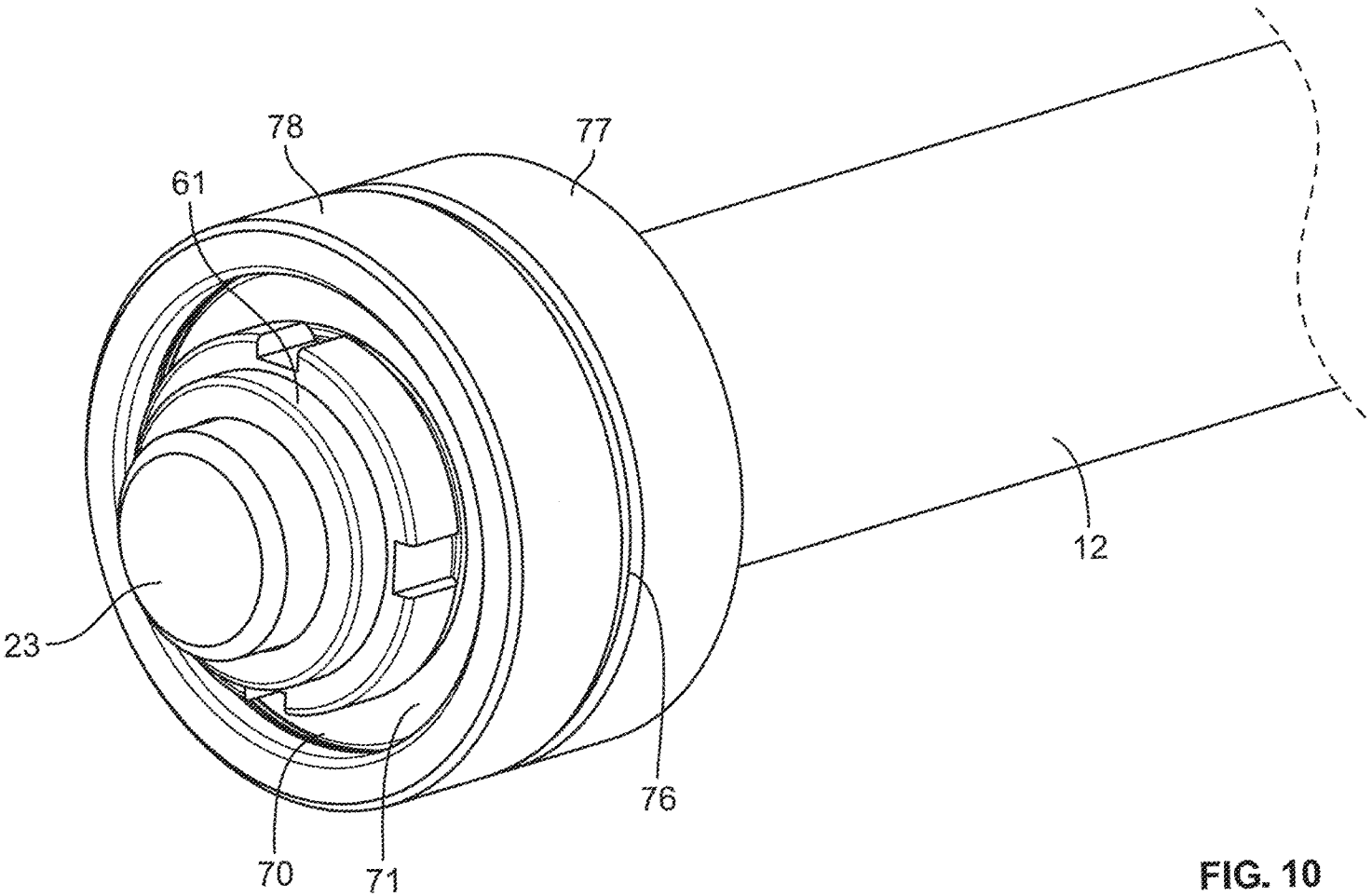
FIG. 10 is a perspective view of a distal bearing assembly of the first sleeve assembly shown in FIG. 4.
Figure 11:
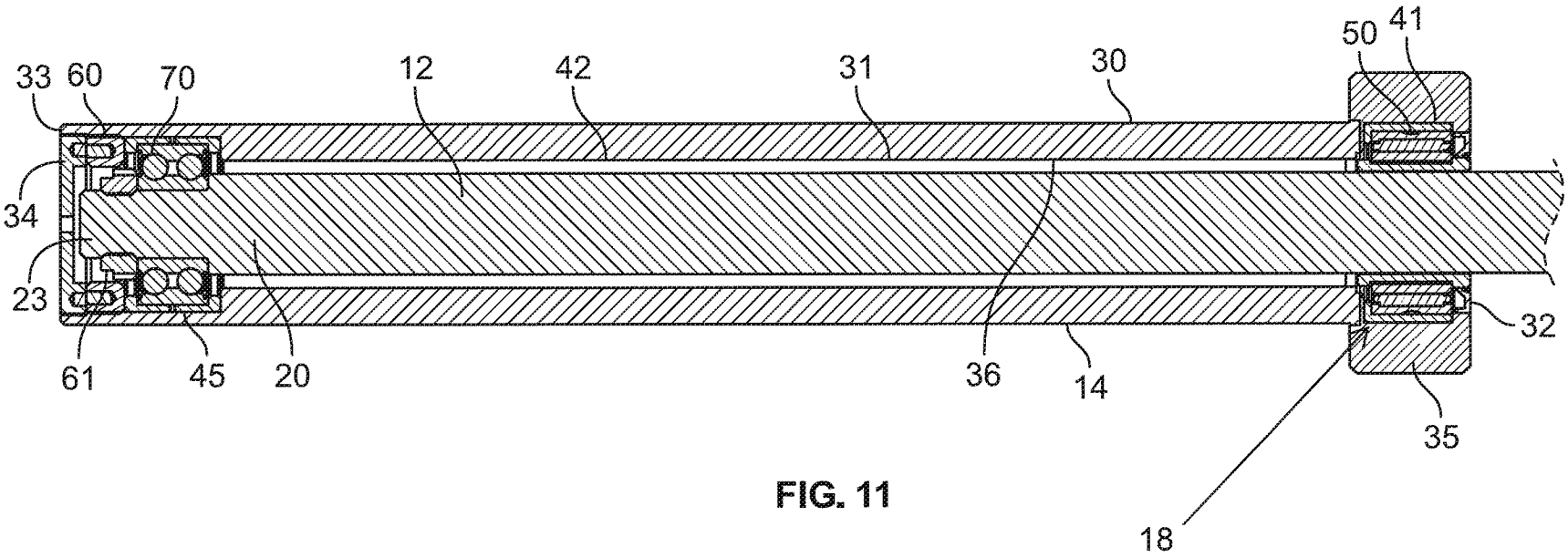
FIG. 11 is a cross-section view of another embodiment of a first sleeve assembly usable with the barbell of FIG. 1.
Figure 12:
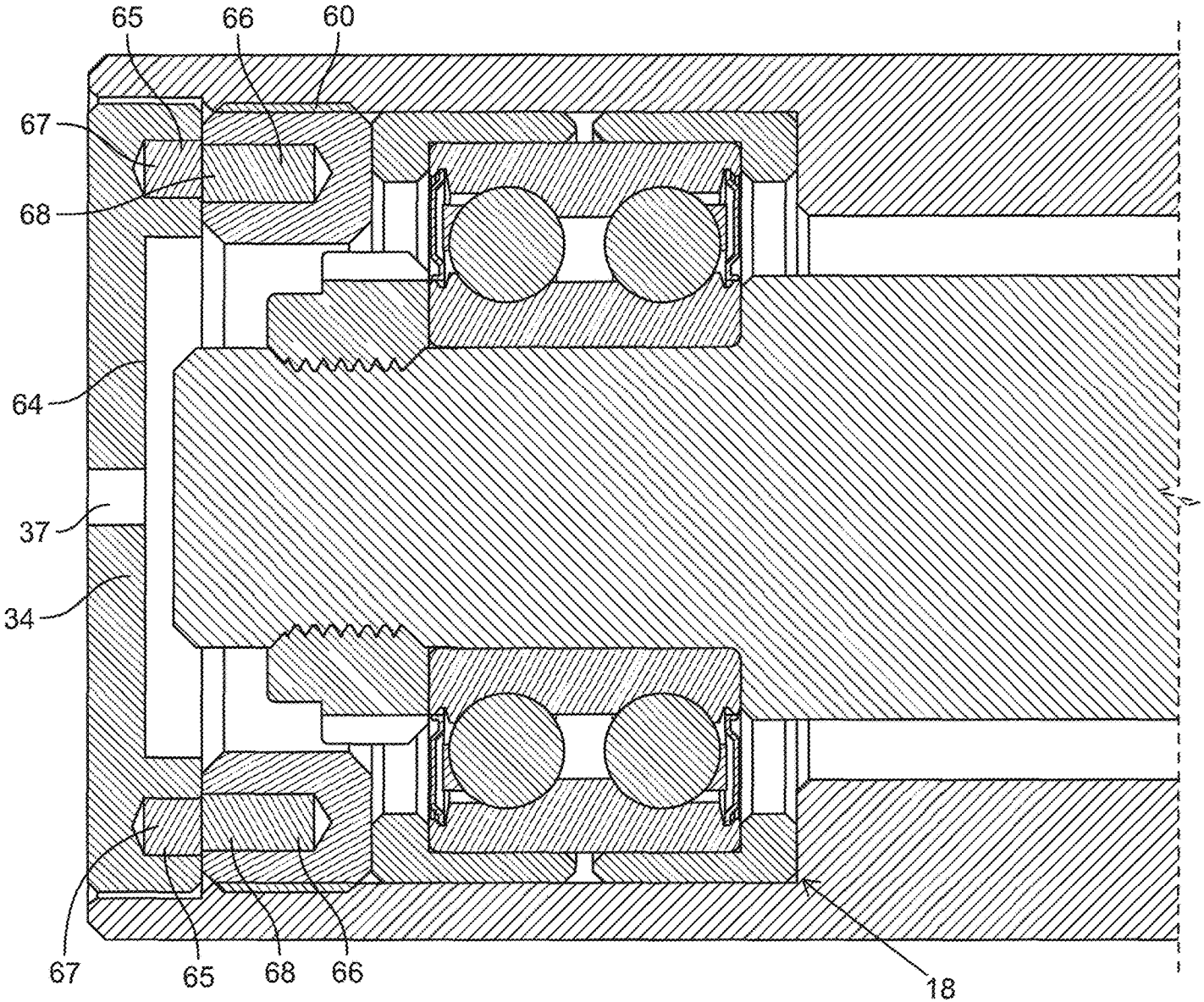
FIG. 12 is a magnified cross-section view of an end portion of the first sleeve assembly of FIG. 11.

The proximal bearing assembly 50 in the embodiment of FIGS. 1-10 is shown in greater detail in FIGS. 4-6. In this embodiment, the proximal bearing assembly 50 has a radial bearing 51 that is generally tubular with circular cylindrical outer and inner races 52, 53, with the inner race 53 defining an axial passage 54, and one or more roller bodies 55 between the races 52, 53. The bearing 51 in FIGS. 1-10 is precision radial bearing in the form of a needle bearing, in which the roller bodies 55 are needle rollers, but a different type of bearing may be used in a different embodiment. The proximal bearing assembly 50 also includes an outer spacer or bushing 56 positioned between and engaging the outer race 52 of the bearing 51 and the inner surface 36 of the sleeve 30, and an inner spacer or bushing 57 positioned between and engaging the inner race 53 of the bearing 51 and one of the end portions 20, 22. The engagement between the proximal bearing assembly 50 and the bar 12 is not fixed in the embodiment of FIGS. 1-10, and the inner bushing 57 forms a smooth, low-friction surface to ease free and smooth rotation of the sleeve 30 and the proximal bearing assembly 50 with respect to the bar 12. The outer bushing 56 fixedly engages the sleeve 30 and the outer race 52 of the bearing 51 in the embodiment of FIGS. 1-10, but may also be rotatable in another embodiment. Further, both the outer and inner bushings 56, 57 engage the sleeve 30 and the bearing 51 axially to hold the bearing assembly 50 and the sleeve 30 in axial position, as well as engaging the sleeve 30 and the bearing 51 radially. Both the outer and inner bushings 56 have lips 58 for such axial engagement in the embodiment of FIGS. 1-10, with the outer bushing 56 having a single lip 58 to create an L-shape in cross-section, and the inner bushing 57 having two lips 58 to create a cup shape in cross-section. The outer bushing 56 and the inner bushing 57 may be made from a smooth, rigid plastic material, e.g., urethane, in one embodiment. The use of a plastic material for the outer and inner bushings 56, 57 may also decrease the noise emitted when the barbell is dropped from an elevated position.

The proximal bearing assembly 50 is positioned within a first bore portion or proximal bore portion 41 extending inwardly/distally from the proximal opening 32 of the sleeve 30, having a larger inner width/diameter than the inner diameter of the central portion 42. The first bore portion 41 may be considered to be an annular recess with respect to the central portion 42 of the bore 31. The bearing 51 and the outer and inner bushings 56, 57 of the proximal bearing assembly 50 are received in the first bore portion 41, which is dimensioned similarly to the outer surface of the outer bushing 56 to achieve tight engagement. The proximal bearing assembly 50 may be inserted by pushing the components of the proximal bearing assembly 50 into the proximal opening 32 of the sleeve 30. The outer bushing 56 may need to be inserted first in some embodiments, followed by the assembled bearing 51 and inner bushing 57. The proximal opening 32 of the sleeve 30 may be beveled or chamfered in order to further assist this insertion. The proximal bearing assembly 50 in the embodiment of FIGS. 1-10 further has a shroud or proximal end cap 59 that is exposed within the proximal opening 32 and assists in protecting the bearing 51. The shroud 59 may be fixedly connected to the inner race 53 or the outer race 52 of the bearing 51, in one embodiment.

The distal bearing assembly 70 in the embodiment of FIGS. 1-10 is shown in greater detail in FIGS. 4 and 7-10. In this embodiment, the distal bearing assembly 70 has a radial bearing 71 that is generally tubular with circular cylindrical outer and inner races 72, 73, with the inner race 73 defining an axial passage 74, and one or more roller bodies 75 between the races 72, 73. The bearing 71 in FIGS. 1-10 is precision radial bearing in the form of a double row angular contact radial bearing, in which the roller bodies 75 are ball rollers, but a different type of bearing may be used in a different embodiment. The distal bearing assembly 70 also includes an outer spacer or bushing 76 positioned between and engaging the outer race 72 of the bearing 71 and the inner surface 36 of the sleeve 30. The inner race 73 of the bearing 71 of the distal bearing assembly 70 engages the end portion 20, 22 of the bar 12 and the sleeve 30 radially, and the distal bearing assembly 70 is engaged from both axial directions by the sleeve 30, the fastener 61, and the spacer ring 60, in order to limit axial movement of the distal bearing assembly 70 with respect to the sleeve 30, and thereby limit axial movement of the sleeve 30 with respect to the bar 12. The sleeve 30, the distal bearing assembly 70, and the bar 12 in the embodiment of FIGS. 1-10 may be fixed against relative axial movement by these structures. The inner race 73 of the bearing 71 in the embodiment of FIGS. 1-10 radially engages the projection 23 at the end portion 20, 22 of the bar 12 and axially engages the fastener 61 and the end portion 20, 22 of the bar 12. The outer bushing 76 is formed of proximal and distal bushing portions 77, 78 that each has a lip 79 for such axial engagement in the embodiment of FIGS. 1-10, such that each bushing portion 77, 78 has an L-shape in cross-section. The proximal bushing portion 77 engages the outer race 72 of the bearing 71 and the inner surface 36 of the sleeve 30 radially and axially. The distal bushing portion 78 engages the outer race 72 of the bearing 71 both radially and axially, and also engages the inner surface 36 of the sleeve 30 radially and engages the spacer ring 60 axially. The outer bushing 76 may be made from a smooth, rigid plastic material, e.g., urethane, in one embodiment. The use of a plastic material for the outer bushing 76 may also decrease the noise emitted when the barbell is dropped from an elevated position. The end portion 20, 22 of the bar 12 in FIGS. 1-10 extends through the passage 74 of the bearing 71 to connect to the fastener 61.

The sleeve 30 has a second bore portion or distal bore portion 45 extending inwardly/proximally from the distal opening 33 of the sleeve 30, having a larger inner width/diameter than the inner diameter of the central bore portion 42. The second bore portion 45 may be considered to be an annular recess with respect to the central portion 42 of the bore 31. The distal bearing assembly 70, the fastener 61, and the spacer ring 60 are received in the second bore portion 45, which is dimensioned similarly to the outer surface of the outer bushing 76 to limit radial movement of the distal bearing assembly 70 with respect to the sleeve 30 and/or to fix the distal bearing assembly 70 against radial movement with respect to the sleeve 30. An abutment surface 46 is positioned at the proximal end of the second bore portion 45, and in this embodiment, the abutment surface 46 is formed as a shoulder that creates a change in diameter between the second bore portion 45 and the central bore portion 42. The abutment surface 46 axially abuts the outer bushing 76, and the spacer ring 60 axially abuts the outer bushing 76 and a ridge 69 located proximally from the distal opening 33 of the sleeve 30. In the embodiment of FIGS. 1-10, these structures fix the distal bearing assembly 70 against axial movement with respect to the sleeve 30. The distal bearing assembly 70 in FIGS. 1-10 permits the sleeve 30 to be rotatable relative to the fastener 61 and the bar 12, which are fixed against rotation with respect to each other. In this configuration, the sleeve 30, the outer bushing 76, the spacer ring 60, the outer race 72 of the bearing 71, and the end cap 34 rotate together as one rotational body, and the bar 12, the fastener 61, and the inner race 73 of the bearing 71 rotate together as another rotational body.

The end caps 34 in the embodiment of FIGS. 1-10 include an O-ring 62 forming the outer diameter, which engages the inner surface 36 of the sleeve 30 to connect the end cap 34 to the sleeve 34. The end cap 34 in this embodiment is shown in greater detail in FIGS. 7 and 9, and includes an annular recess 63 around the outer circumference that receives the O-ring 62, such that a portion of the O-ring 62 extends beyond the outer circumference of the end cap 34. The O-ring 62 may be formed of rubber, silicone, or another flexible and resilient material that is compressible. The O-ring 62 of the end cap 34 in this configuration tightly engages the inner surface 36 of the sleeve 30, such that the friction force and interference between the O-ring 62 and the sleeve 30 holds the end cap 34 in place. The sleeve 30 may have a detent 38 proximate the distal opening 33 that receives the O-ring 62 to increase the security of the mounting configuration. The end cap 34 may also abut the spacer ring 60. The end cap 34 includes a center recess 64 to avoid abutting the projection 23 of the bar 12 and an aperture 37 that may permit insertion of a tool for pulling the end cap 34 from the sleeve assembly 14, 16.

In an example embodiment, the outer and inner bushings 56, 57 of the proximal bearing assembly 50 and the outer bushing 76 of the distal bearing assembly 70 are all made from polymer materials, which includes pure and mixed polymer materials, as well as polymer-matrix composite materials. These components may be manufactured using any of a variety of techniques or combinations of such techniques, including molding, casting, thermoforming, extrusion, machining, etc. The bushings 56, 57, 76 may all be made from the same polymer material, or some or all of these components may be made from different polymer materials, in various embodiments. The polymer material may be selected based on desirable properties, including strength, durability, low friction properties (e.g., coefficient of friction), and vibration/sound absorption or damping properties. In one embodiment, the polymer material may have a durometer hardness of 50 Shore A to 100 Shore A. One example of a suitable material that provides advantageous performance in this application is a urethane or polyurethane material. Other polymer materials may provide suitable and/or advantageous performance as well. The polymer material(s) of the bushings 56, 57, 76 may be selected for lubricity properties and compatibility with potential lubricants, in such a configuration. The use of these polymer components provides benefits such as isolating the bearings 51, 71 from shock and protecting the bearings 51, 71 and the bar 12 from damage, permitting looser tolerances between the bearings 51, 71 and the sleeves 30 and thereby facilitating manufacturing, and reducing noise emitted when the barbell 10 is dropped.

It is understood that the bushings 56, 57, 76 may have inserts, cores, or other internal components or portions made from other materials, such as metal, in one embodiment. For example, any of the bushings 56, 57, 76 and/or components thereof may be made from metal pieces coated with a polymer material on one or more surfaces, e.g., a polymer piece with a metal core. Such bushings 56, 57, 76 and/or components thereof are still considered to be formed of a polymer material as discussed herein. Components described herein as being "formed of a polymer material" may be considered to be formed of one or more polymer materials, such that a first component is formed of a first polymer material, a second component is formed of a second polymer material, etc., which materials may be the same or different.

To assemble the barbell 10 in the embodiment of FIGS. 1-10, the proximal bearing assemblies 50 are first inserted into the proximal openings 32 of the sleeves 30 as described herein. The end portions 20, 22 of the bar 12 are inserted into the bores 31 of the sleeves 30, through the proximal bearing assemblies 50, so that the distal ends 24 of the bar 12 extend into the second bore portions 45 of the sleeves 30. The proximal bushing portions 77 are then inserted into the second bore portions 45 through the distal openings 33 of the sleeves 30, followed by (or concurrently with) the bearings 71 of the distal bearing assemblies 70. The distal bushing portions 78 are then inserted into the second bore portions 45 through the distal openings 33 of the sleeves 30, and the fasteners 61 are connected to the projections 23 of the bar 12. The spacer rings 60 and the end caps 34 are then inserted into the second bore portions 45 to complete assembly. Removal or disassembly of these components can be accomplished by reversing the steps discussed above.

Figure 13:
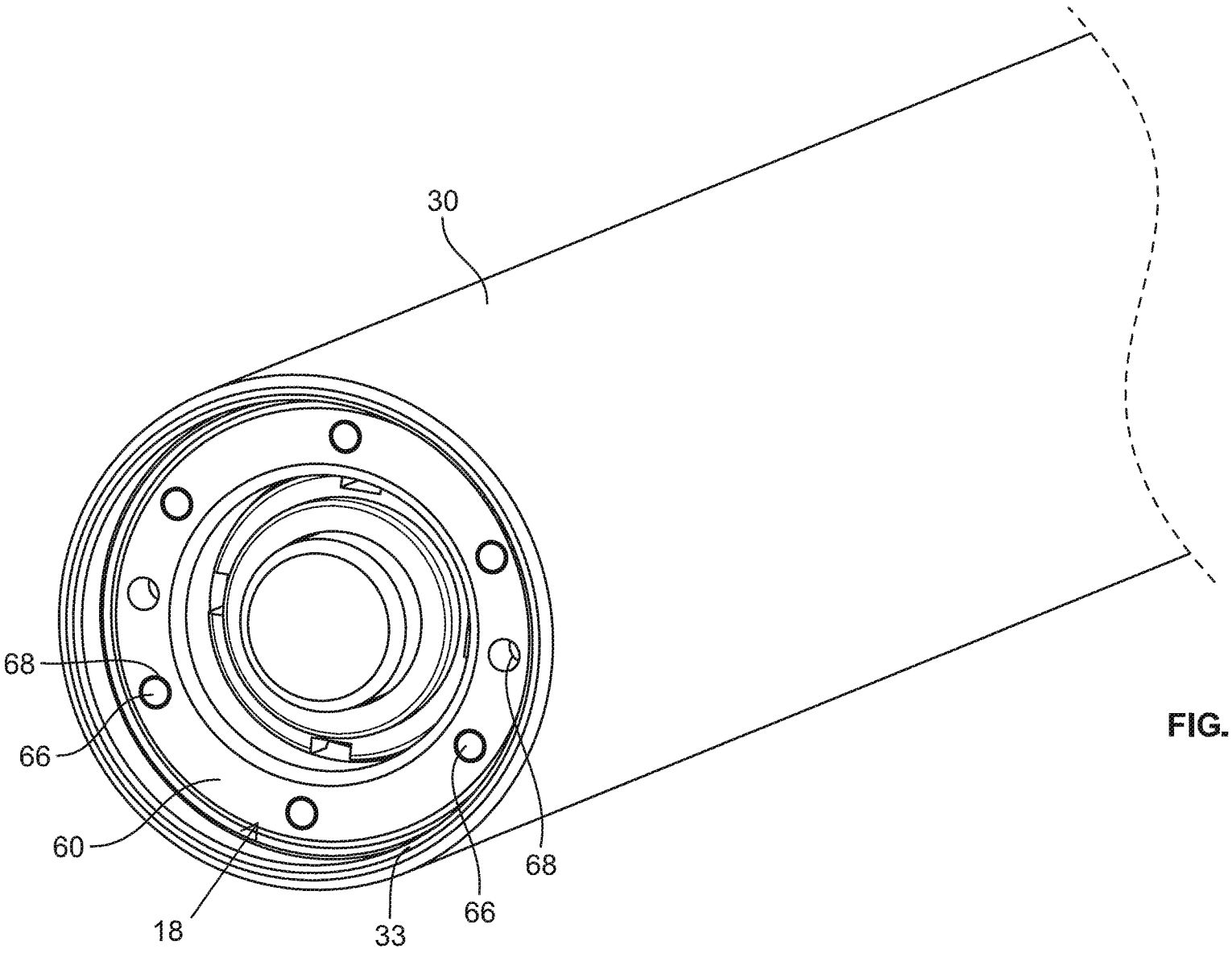
FIG. 13 is a perspective view of the portion of the first sleeve assembly shown in FIG. 12, with an end cap removed to show internal detail.
Figure 14:
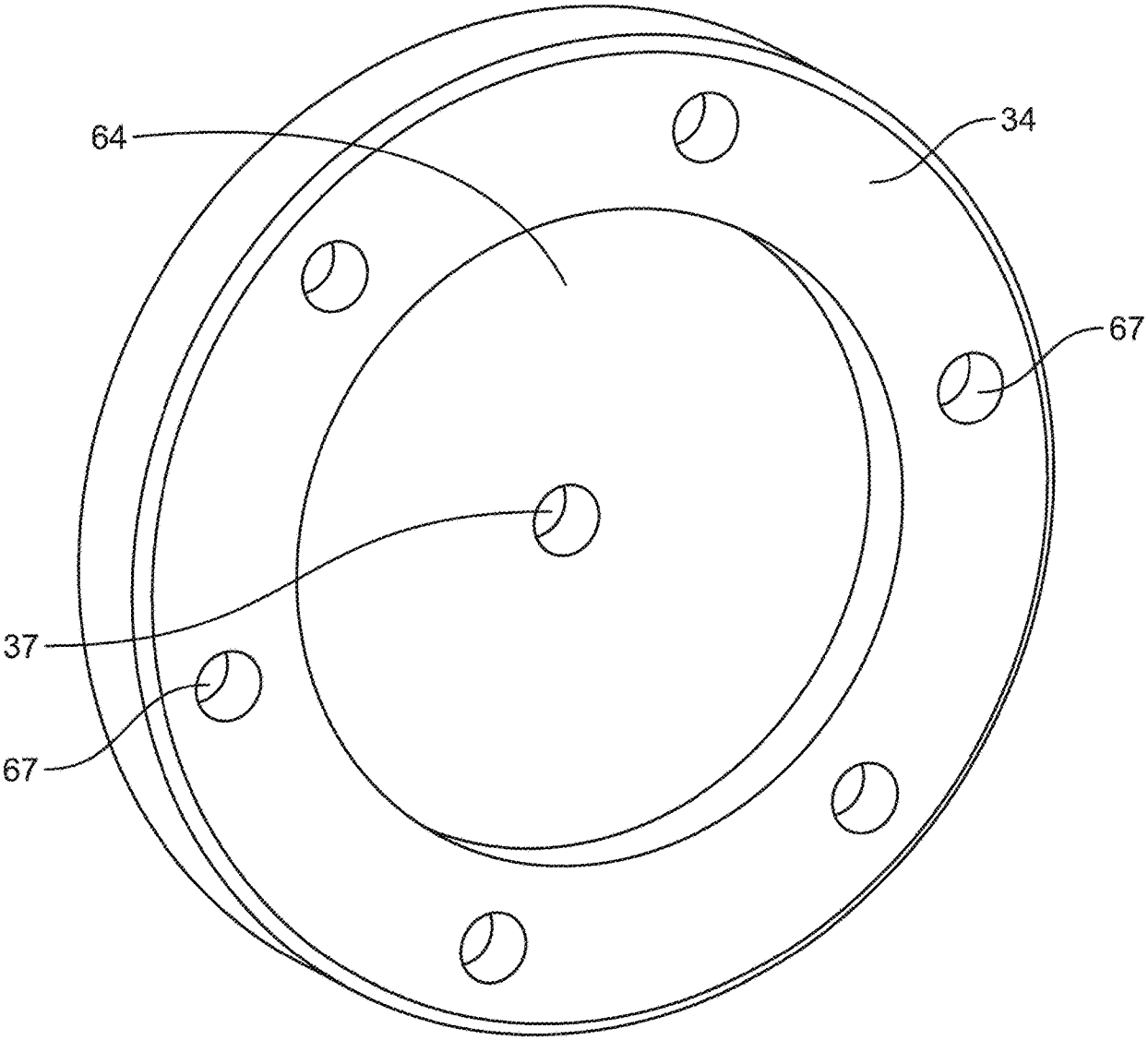
FIG. 14 is a perspective view of the end cap of the first sleeve assembly shown in FIG. 11.
Figure 15:
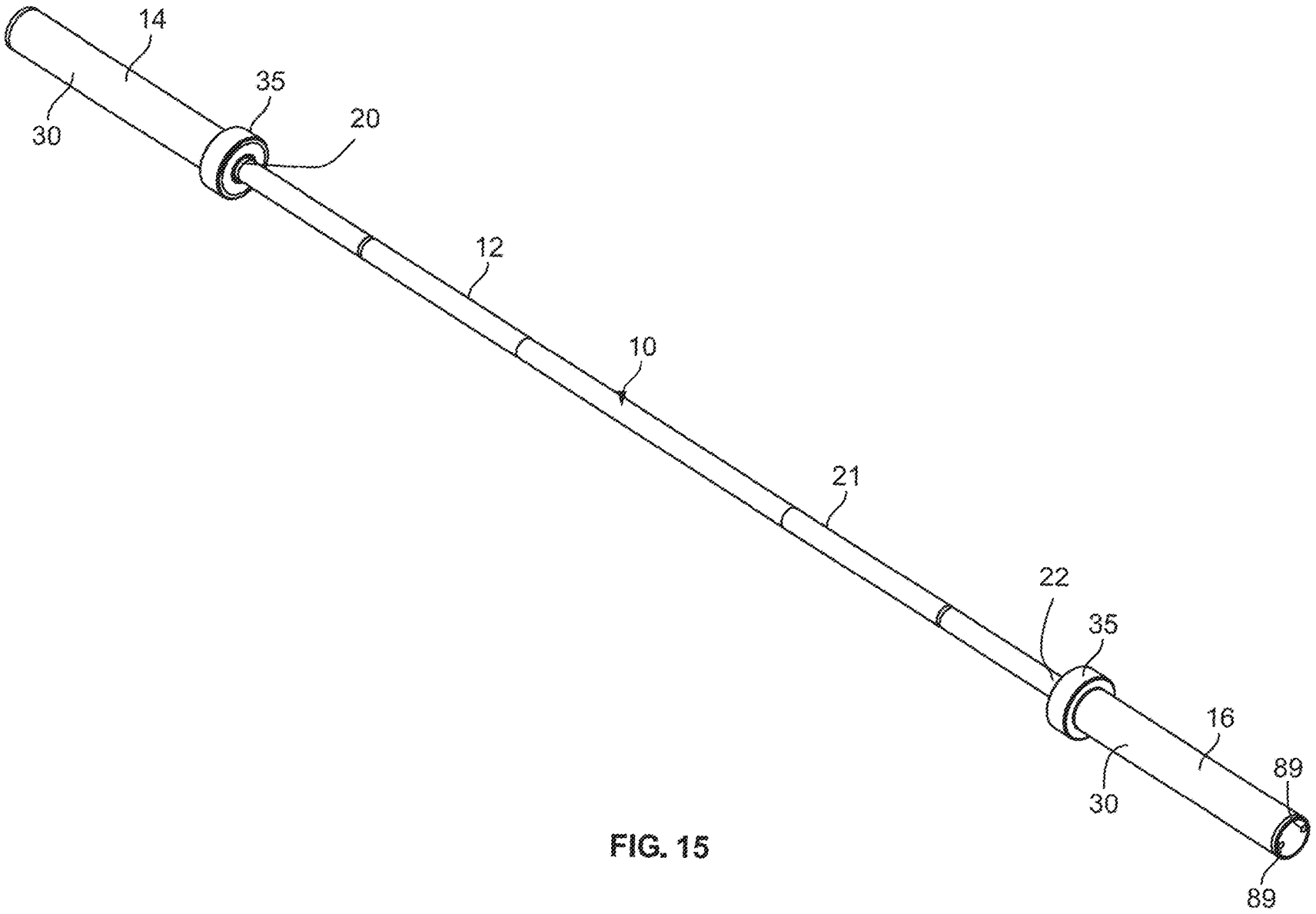
FIG. 15 is a perspective view of another embodiment of a barbell according to aspects of the present disclosure.
Figure 16:
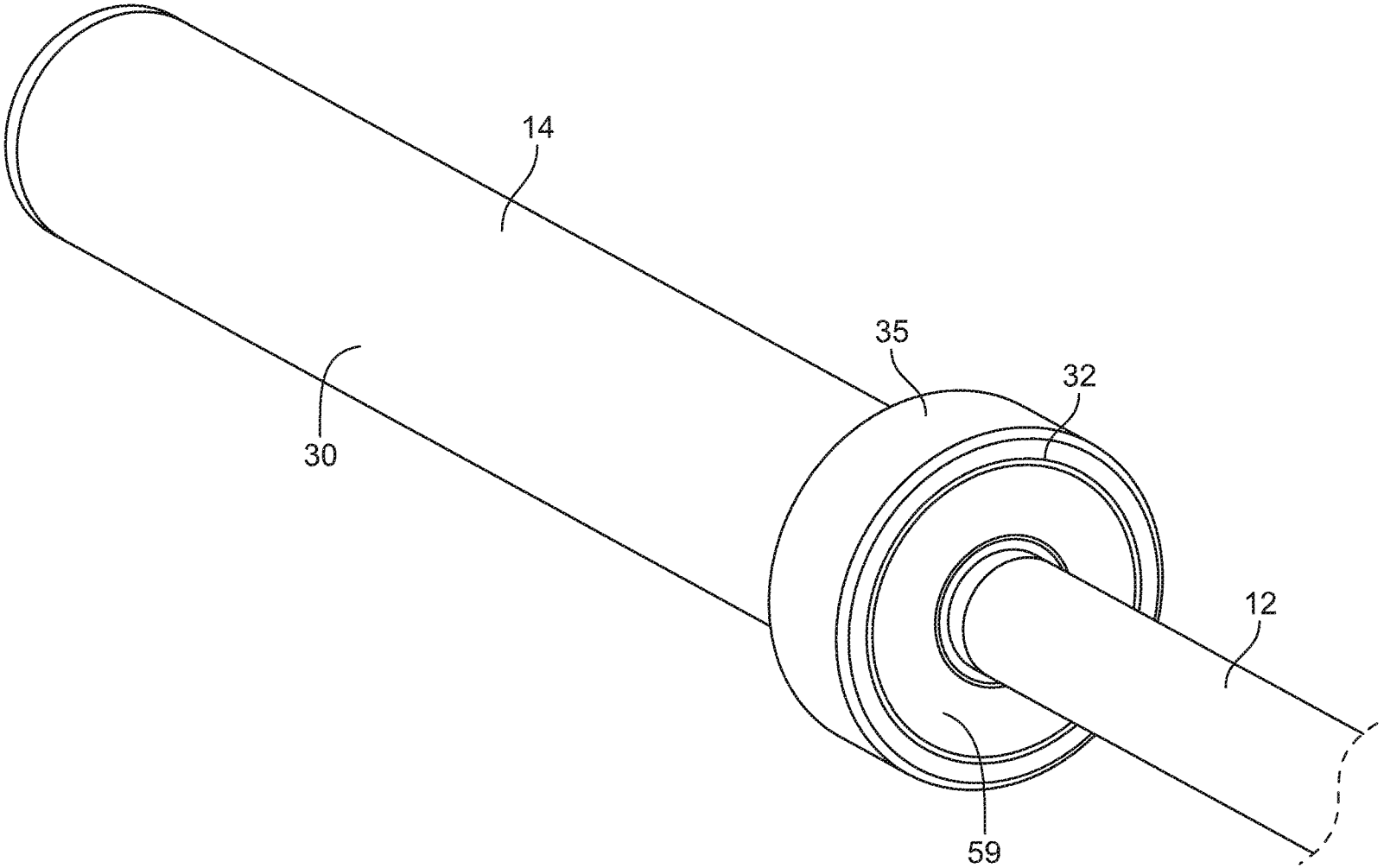
FIG. 16 is a perspective view of a first sleeve assembly of the barbell of FIG. 15.

FIGS. 11-14 illustrate another embodiment of a barbell 10 that is generally similar or identical to the barbell 10 of FIGS. 1-10, with the exception of the configuration of the end caps 34. The components of the barbell 10 of FIGS. 11-14 that are similar to the components of the barbell 10 in FIGS. 1-10 are not described herein in detail for the sake of brevity, and such components are referred to herein in the drawings using identical reference numbers. The end caps 34 of the barbell 10 in FIGS. 11-14 are connected to the sleeve assemblies 14, 16 using a magnetic arrangement. In this configuration, the end caps 34 include one or more first magnetic members 65 and the sleeve assemblies 14, 16 include one or more second magnetic members 66 that are attracted to the first magnetic members 65. In the configuration of FIGS. 11-14, the first magnetic members 65 are received in recesses 67 in the inner surface of the end cap 34, and the second magnetic members 66 are received in receivers 68 on the outer surface of the spacer ring 60. As shown in FIG. 13, in one embodiment, six second magnetic members 66 may be used, and it is understood that six first magnetic members 65 may also be used. In one embodiment, the magnetic polarity of the first and second magnetic members 65, 66 may alternate between adjacent magnetic members 65, 66. In this configuration, that rotation of the end cap 34 can bring magnetic members 65, 66 with attracting polarities into engagement with each other to connect the end cap 34, or can bring magnetic members 65, 66 with repelling polarities into engagement with each other to ease removal of the end cap 34. In another embodiment, all of the first magnetic members 65 may have one polarity and all of the second magnetic members 66 may have the opposite polarity. In this configuration, the magnetic members 65, 66 may be arranged to permit connection of the end cap 34 in a plurality of different rotational positions. Rotation of the end cap 34 in this configuration may ease removal of the end cap by disconnecting the magnetic members 65, 66. It is understood that the aperture 37 in the end cap 34 may be configured to be engaged for rotation of the end cap 34, such as by having a non-circular profile, in one embodiment.

FIGS. 15-20 illustrate another embodiment of a barbell 10 that is generally similar or identical to the barbell 10 of FIGS. 1-10 in many aspects, with some differences discussed herein. The components of the barbell 10 of FIGS. 15-20 that are similar to the components of the barbell 10 in FIGS. 1-10 are not described herein in detail for the sake of brevity, and such components are referred to herein in the drawings using identical reference numbers. The barbell 10 of FIGS. 15-20 has a proximal bearing assembly 50, a distal bearing assembly 70, and an end cap 34 configuration that are different from the embodiment of FIGS. 1-10.

Figure 19:
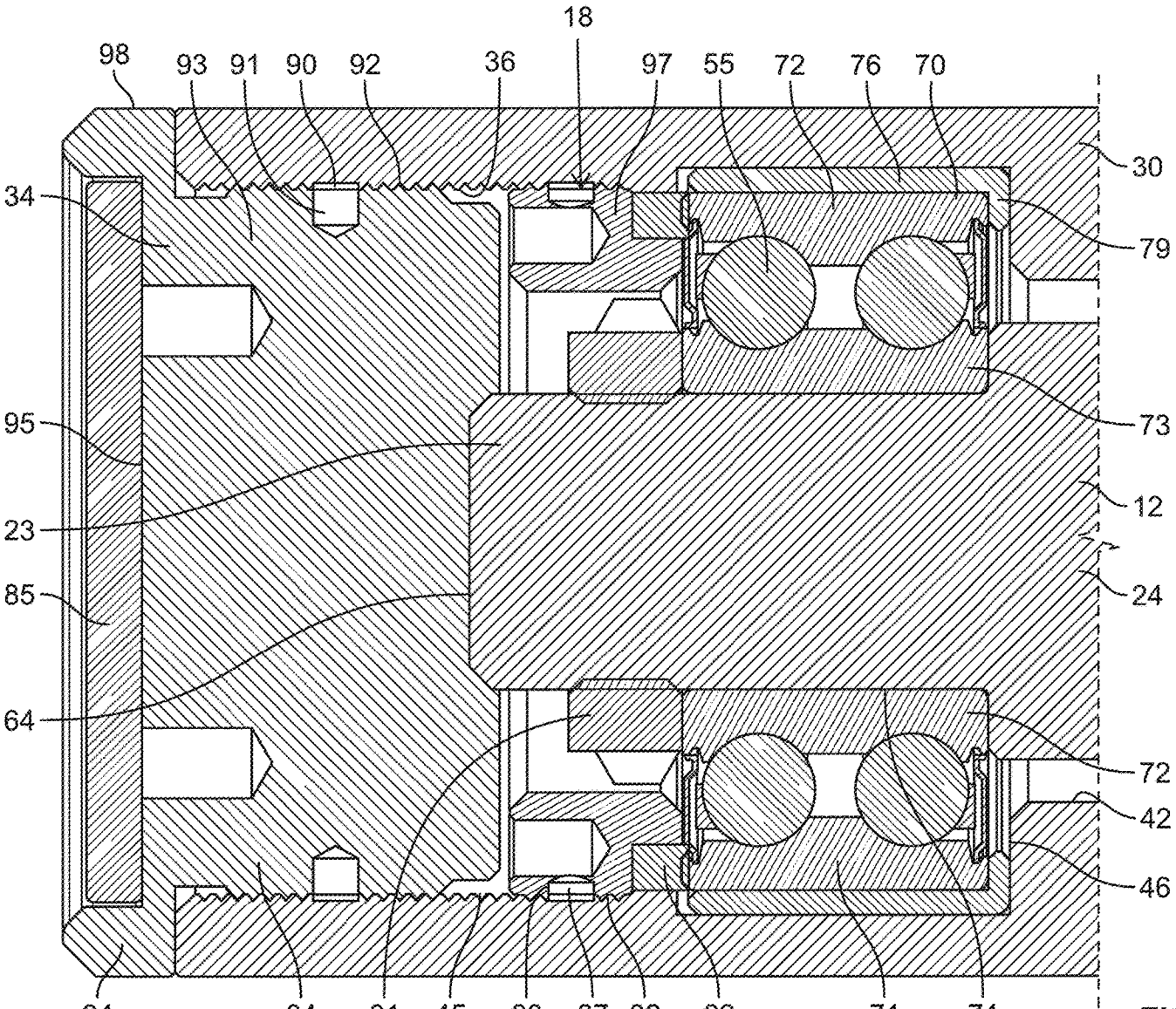
FIG. 19 is a magnified cross-section view of an end portion of the first sleeve assembly of FIG. 17.
Figure 20:
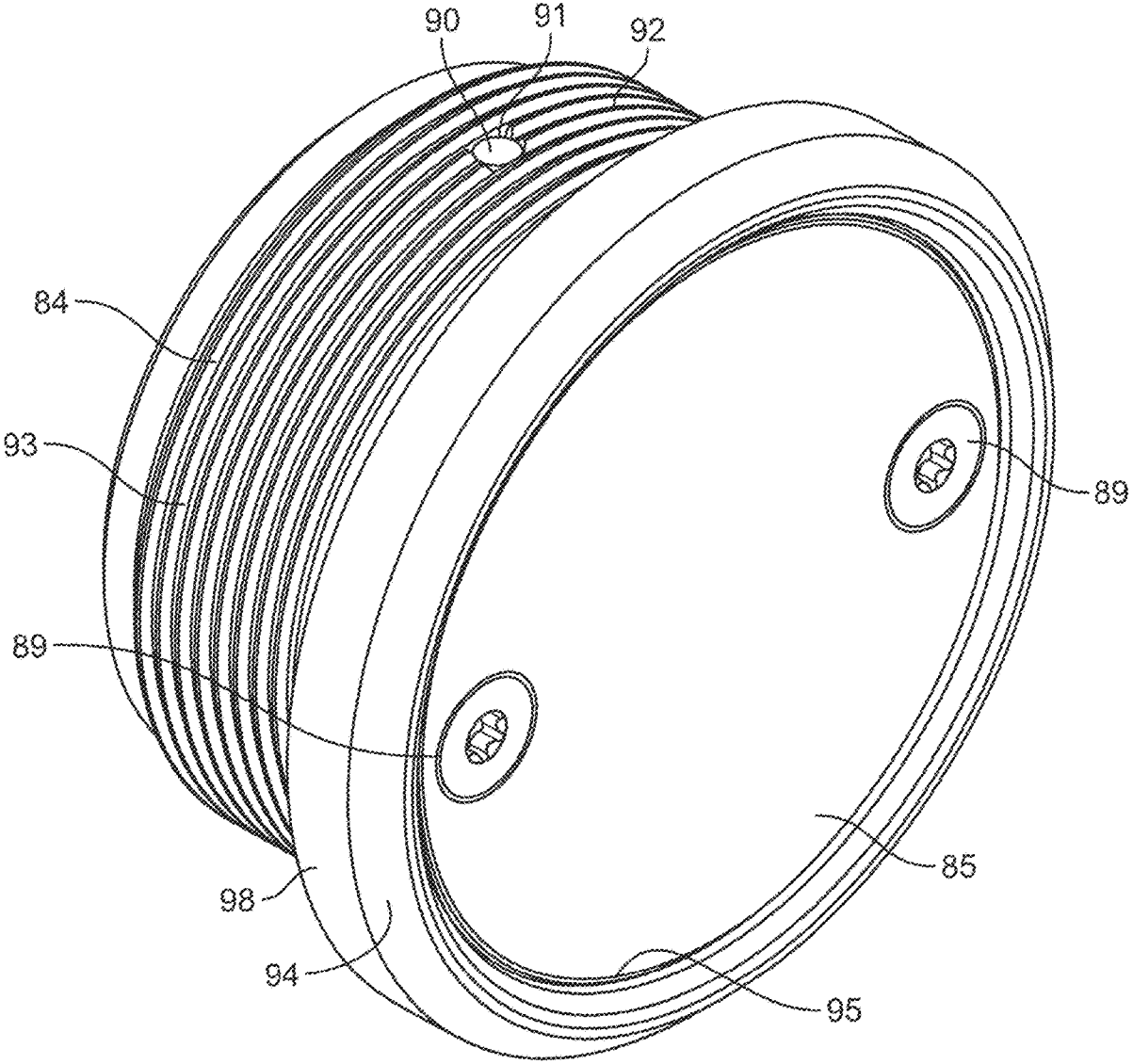
FIG. 20 is a perspective view of an end cap of the first sleeve assembly shown in FIG. 16.

The proximal bearing assembly 50 in the embodiment of FIGS. 15-20 is shown in greater detail in FIG. 20. In this embodiment, the proximal bearing assembly 50 has a bearing 51 with circular cylindrical outer and inner races 52, 53, with the inner race 53 defining an axial passage 54, and one or more roller bodies 55 between the races 52, 53. The bearing 51 in FIGS. 15-20 is a sealed, self-aligning bearing with two sets of annularly arranged roller bodies 55, but a different type of bearing may be used in a different embodiment. The inner race 53 of the bearing 51 in FIGS. 15-20 has annular channels 53A that each receive one of the sets of the roller bodies 55, and the outer race 52 has a single annular channel 52A that is smoothly and concavely curved, in which both sets of the roller bodies 55 are received. This configuration permits some angular and/or axial misalignment of the bearing 51 without damaging the bearing 51 or degrading functionality of the bearing 51. The bar 12 and the sleeve 30 frequently undergo some degree of bending and axial shock during use, particularly when dropped from a height while loaded. The self-aligning bearing 51, with the single channel 52A in the outer race 52, permits the bearing 51 to move with such bending and axial shock, rather than absorbing this force. For example, in one embodiment, the bearing 51 in FIGS. 15-20 can experience up to 4° of angular misalignment between the inner and outer races 53, 52. The use of the self-aligning bearing 51 therefore resists damage to both the bearing 51 and the bar 12 through use. In the embodiment of FIGS. 15-20, the bearing 51 is a ball bearing where the roller bodies 55 are balls. In another embodiment, the bearing 51 may be a self-aligning roller bearing where the roller bodies 55 are barrel rollers, which has a similar structure to the bearing 51 of FIGS. 15-20, having two channels 53A on the inner race 53 and a single channel 52A on the outer race 52. It is understood that the "channels" as described herein may be defined as when the surface of the race 52, 53 in question has two separate concave profiles and does not have a continuously concave profile, such as if the channels are separated by a ridge or other raised structure.

The proximal bearing assembly 50 also includes an outer spacer or bushing 56 positioned between and engaging the outer race 52 of the bearing 51 and the inner surface 36 of the sleeve 30, and an inner spacer or bushing 57 positioned between and engaging the inner race 53 of the bearing 51 and one of the end portions 20, 22. The outer bushing 56 fixedly engages the sleeve 30 and the outer race 52 of the bearing 51 in the embodiment of FIGS. 15-20, such that the sleeve 30, the outer bushing 56, and the outer race 52 rotate together. The engagement between the proximal bearing assembly 50 and the bar 12 is substantially fixed in the embodiment of FIGS. 15-20. More specifically, the inner bushing 57 in this configuration tightly engages the inner race 53 of the bearing 51 and the bar 12, such that the inner bushing 57, the inner race 53 of the bearing 51, and the bar 12 rotate together. This configuration allows rotation to occur between the races 52, 53 of the bearing and protects the bar 12 against damage. In another embodiment, the outer bushing 56 and/or the inner bushing 57 may be moveable and rotatable with respect to the components described above. Further, both the outer and inner bushings 56, 57 engage the sleeve 30 and the bearing 51 axially to hold the bearing assembly 50 and the sleeve 30 in axial position, as well as engaging the sleeve 30 and the bearing 51 radially. Both the outer and inner bushings 56 have lips 58 for such axial engagement in the embodiment of FIGS. 15-20. The outer bushing 56 in this embodiment has a single lip 58 to create an L-shape in cross-section similar to the embodiment of FIGS. 1-10. The inner bushing 57 in this embodiment has two lips 58, including one lip 58 at the distal end and another lip 58 located between the proximal and distal ends to create a flanged cup or F-shape in cross-section. The outer bushing 56 and the inner bushing 57 may be made from a smooth, rigid plastic material, e.g., urethane, in one embodiment. The use of a plastic material for the outer and inner bushings 56, 57 may also decrease the noise emitted when the barbell is dropped from an elevated position.

The proximal bearing assembly 50, including the bearing 51 and the outer and inner bushings 56, 57, is positioned within a first bore portion or proximal bore portion 41, similar to the embodiment of FIGS. 1-10. The proximal bearing assembly 50 may be inserted by pushing the components of the proximal bearing assembly 50 into the proximal opening 32 of the sleeve 30. The outer bushing 56 may need to be inserted first in some embodiments, followed by the assembled bearing 51 and inner bushing 57. The proximal bearing assembly 50 also includes a retaining member 80, such as a snap ring or other retaining ring, engaging the proximal bore portion 41 and positioned proximally of the bearing 51 to hold the outer bushing 56 and the bearing 51 within the proximal bore portion 41, as well as a proximal end cap 59 that is exposed within the proximal opening 32 and assists in protecting the bearing 51. The proximal end cap 59 in FIGS. 15-20 is removably mounted within the proximal opening 32, such as by using an outer O-ring 81 to engage the proximal bore portion 41, similar to the end caps 34 in the embodiment of FIGS. 1-10. The radially outer surface of the proximal end cap 59 and the radially inner surface surrounding the proximal opening 32 both have grooves or channels 81A, 81B that receive portions of the O-ring 81 to hold the proximal end cap 59 in place. The transition between the proximal bore portion 41 and the central portion 42 of the sleeve 30 is a beveled transition 83, having an oblique angular profile and a frustoconical shape. This beveled transition 83 provides space to permit angular and/or axial movement of the inner race 53 of the bearing 51 as described above. The proximal end cap 59 also has a cut-out 96 to provide space to permit angular and/or axial movement of the inner race 53 of the bearing 51 as well.

Figure 17:
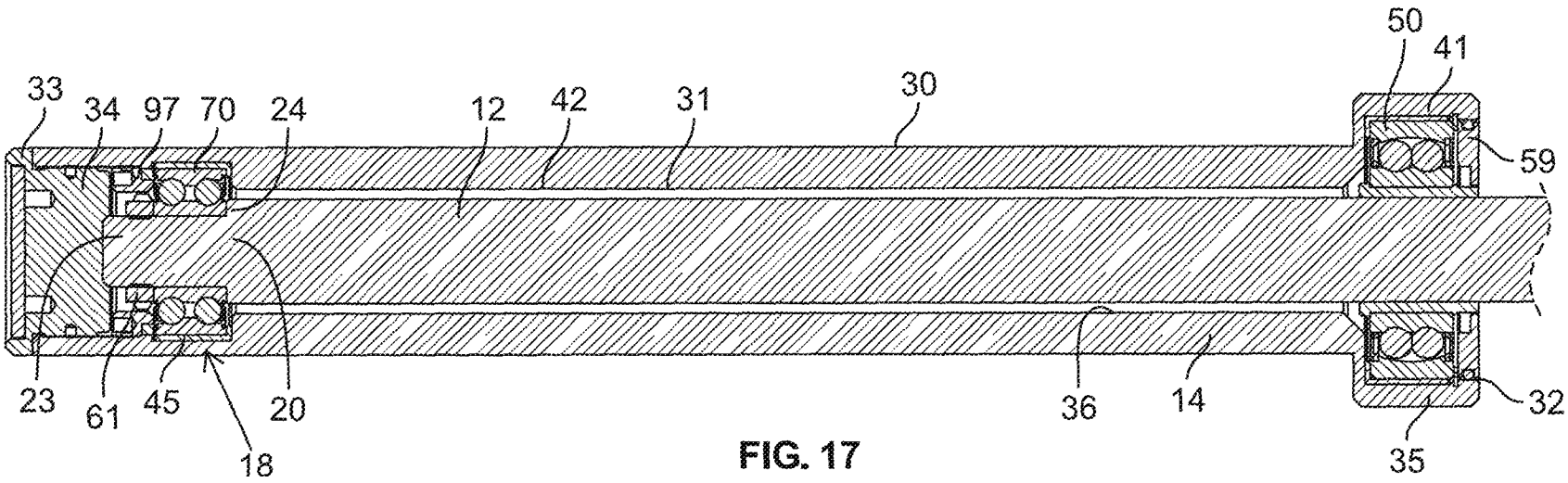
FIG. 17 is a cross-sectional view of the first sleeve assembly of the barbell of FIG. 15.
Figure 18:
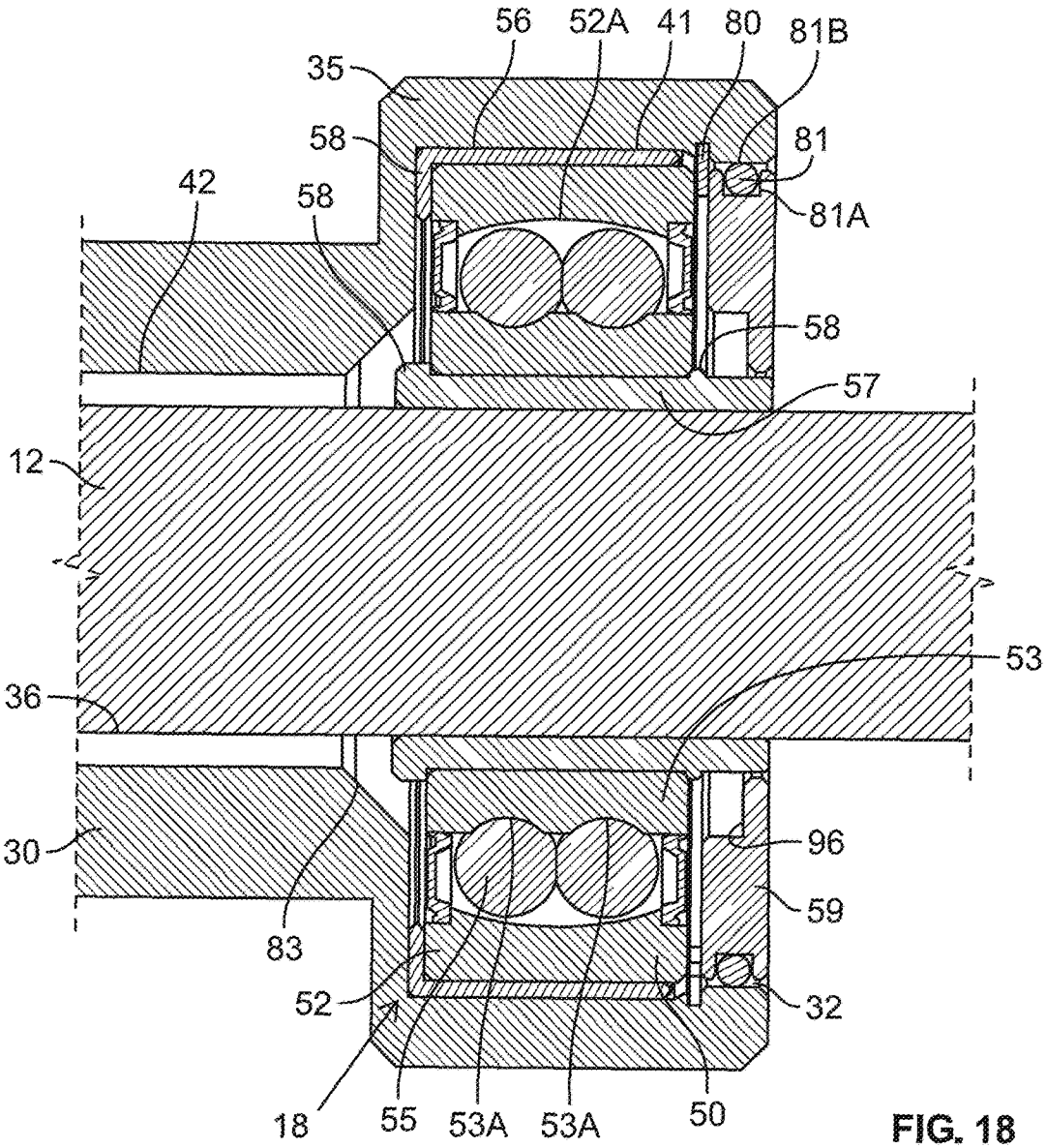
FIG. 18 is a magnified cross-section view of a portion of the first sleeve assembly of the barbell of FIG. 17.

The distal bearing assembly 70 in the embodiment of FIGS. 15-20 is shown in greater detail in FIGS. 17 and 19. In this embodiment, the distal bearing assembly 70 has a radial bearing 71 that is generally tubular with circular cylindrical outer and inner races 72, 73, with the inner race 73 defining an axial passage 74, and one or more roller bodies 75 between the races 72, 73. The bearing 71 in FIGS. 15-20 is a precision radial bearing in the form of a double row angular contact radial bearing, in which the roller bodies 75 are ball rollers, but a different type of bearing may be used in a different embodiment. The bearing 71 in FIGS. 15-20 fixes the sleeve 30 to the bar 12 but also permits the sleeve 30 to rotate with respect to the bar 12. The distal bearing assembly 70 also includes an outer spacer or bushing 76 positioned between and engaging the outer race 72 of the bearing 71 and the inner surface 36 of the sleeve 30. The outer bushing 76 may be formed of urethane in one example, and the outer bushing 76 absorbs impacts, decreases noise resulting from dropping the barbell 10, and protects the bearing 71 from shock. A retainer 97 in the form of a collar nut engages the distal bearing assembly 70 and retains the distal bearing assembly 70 within the sleeve 30. The retainer 97 in this embodiment includes an annular bumper 82 extending axially from the proximal side that engages the outer race 72 of the bearing 71, which may be integral with the retainer 97 or may be a different material connected to the retainer 97, e.g., a rubber, silicone, or polyurethane material. In one embodiment, the bumper 82 is a urethane ring, and the retainer 97 is formed of stainless steel or another metallic material. The retainer 97 is connected within the sleeve 30 by threading in the embodiment of FIGS. 15-20. The sleeve 30 has a threaded inner surface 36, and the radially outer surface 86 of the retainer 97 has complementary threading. Additionally, the retainer 97 has one or more locking members 87, each in the form of a plug of a resilient material such as nylon or other resilient polymer material that is received in a bore 88 extending inward from the radially outer surface 86 of the retainer 97. The locking member(s) 87 engage the threaded inner surface 36 of the sleeve 30 to resist rotation of the retainer 97, thereby resisting slippage of the retainer 97. A different type of locking member 87 may be used in another embodiment, such as a strip of resilient material positioned within a slot in the respective threaded surface.

The inner race 73 of the bearing 71 of the distal bearing assembly 70 engages the end portion 20, 22 of the bar 12 and the sleeve 30 radially, and the distal bearing assembly 70 is engaged from both axial directions by the sleeve 30, the fastener 61, and the retainer 97, in order to limit axial movement of the distal bearing assembly 70 with respect to the sleeve 30, and thereby limit axial movement of the sleeve 30 with respect to the bar 12. The sleeve 30, the distal bearing assembly 70, and the bar 12 in the embodiment of FIGS. 15-20 may be fixed against relative axial movement by these structures. The inner race 73 of the bearing 71 in the embodiment of FIGS. 15-20 radially engages the projection 23 at the end portion 20, 22 of the bar 12 and axially engages the fastener 61 and the end portion 20, 22 of the bar 12. The outer bushing 76 has a lip 79 at the proximal end for axial engagement of the outer race 72 of the bearing 71 in the embodiment of FIGS. 15-20, such that the outer bushing 76 has an L-shape in cross-section. The outer bushing 76 engages the outer race 72 of the bearing 71 and the inner surface 36 of the sleeve 30 radially and axially and may also engage the retainer 97 axially. The outer bushing 76 may be made from a smooth, rigid plastic material, e.g., urethane, in one embodiment. The use of a plastic material for the outer bushing 76 may also decrease the noise emitted when the barbell is dropped from an elevated position. The end portion 20, 22 of the bar 12 in FIGS. 15-20 extends through the passage 74 of the bearing 71 to connect to the fastener 61. The barbell 10 in FIGS. 15-20 also has an end cap 34 that covers the distal opening 33 of the sleeve 30.

The sleeve 30 in FIGS. 15-20 has a second bore portion or distal bore portion 45 extending inwardly/proximally from the distal opening 33 of the sleeve 30, having a larger inner width/diameter than the inner diameter of the central bore portion 42. The second bore portion 45 may be considered to be an annular recess with respect to the central portion 42 of the bore 31. The distal bearing assembly 70, the fastener 61, and the retainer 97 are received in the second bore portion 45, which is dimensioned similarly to the outer surface of the outer bushing 76 to limit radial movement of the distal bearing assembly 70 with respect to the sleeve 30 and/or to fix the distal bearing assembly 70 against radial movement with respect to the sleeve 30. An abutment surface 46 is positioned at the proximal end of the second bore portion 45, and in this embodiment, the abutment surface 46 is formed as a shoulder that creates a change in diameter between the second bore portion 45 and the central bore portion 42. The abutment surface 46 axially abuts the outer bushing 76, and the retainer 97 axially abuts the bearing 71 and is fixed axially by threaded engagement with the inner surface 36 of the second bore portion 45. In the embodiment of FIGS. 15-20, these structures fix the distal bearing assembly 70 against axial movement with respect to the sleeve 30. The distal bearing assembly 70 in FIGS. 15-20 permits the sleeve 30 to be rotatable relative to the fastener 61 and the bar 12, which are fixed against rotation with respect to each other. In this configuration, the sleeve 30, the outer bushing 76, the retainer 97, the outer race 72 of the bearing 71, and the end cap 34 rotate together as one rotational body, and the bar 12, the fastener 61, and the inner race 73 of the bearing 71 rotate together as another rotational body.

The end cap 34 in FIGS. 15-20 includes an end cap base 84 and an outer plate 85 connected to the end cap base 84. The outer plate 85 is removably connected to the end cap base 84 in one embodiment, such as by screws or other fasteners 89 as in the embodiment of FIGS. 15-20. In this configuration, the outer plate 85 of the end cap 34 is interchangeable with appropriately structured outer plates 85, permitting aesthetic customization of the barbell 10 by interchanging outer plates 85 having different cosmetic appearances. The end cap base 84 may be made from stainless steel in one embodiment, and the size or axial length of the end cap base 84 may be selected to provide a desired weight, such as to control the weight of the barbell 10 to match specified standards (e.g., Olympic weight standards). The end cap 34 may be connected to the sleeve 30 in this embodiment by complementary threading on the inner surface 36 of the sleeve 30 and the outer surface of the end cap 34. In the embodiment of FIGS. 15-20, the end cap base 84 has a threaded portion 92 on the outer surface that engages with the threaded inner surface 36 of the sleeve 30 to form this connection. The end cap base 84 also has one or more locking members 90 received in a bore 91 extending inward from the threaded portion 92 of the end cap base 84 and is configured to engage the threading on the inner surface 36 of the sleeve 30, as similarly described with respect to the retainer 97.

The end cap base 84 in the embodiment of FIGS. 15-20 has a first or proximal portion 93 that is received within the second bore portion 45 of the sleeve 30 and a second or distal portion 94 that extends out of the sleeve 30 and forms a portion of the exterior of the barbell 10. The proximal portion 93 of the end cap base 84 has the threaded portion 92 in this embodiment, to engage the threading on the sleeve 30. The proximal portion 93 also has a center recess 64 to avoid abutting the projection 23 of the bar 12. The distal portion 94 has a distal recess 95 that receives the outer plate 85 of the end cap 34 as discussed herein. The distal portion 94 in FIGS. 15-20 has a diameter that is wider than the diameter of the proximal portion 93, and approximately equal to the diameter of the sleeve 30. The distal recess 95 in this embodiment is a circular cavity receiving the outer plate 85 and has structure for connection of fasteners 89. The distal portion 94 of the embodiment of FIGS. 15-20 extends axially out through the distal opening 33 of the sleeve 30 and also extends radially outward, such that the distal portion 94 overlaps the distal end of the sleeve 30, and the radially outer edge 98 of the distal portion 94 is substantially flush with the outer surface of the sleeve 30 and forms a portion of the outer profile of the barbell 10 and the outer surface of the sleeve 30. The end caps 34 in the embodiment of FIGS. 15-20 may connect to the sleeve 30 in a different manner in other embodiment, such as the O-ring and/or fasteners described herein.

To assemble the barbell 10 in the embodiment of FIGS. 15-20, the proximal bearing assemblies 50 are first inserted into the proximal openings 32 of the sleeves 30 as described herein, and the proximal end caps 59 are then inserted into the proximal openings 32. The end portions 20, 22 of the bar 12 are inserted into the bores 31 of the sleeves 30, through the proximal bearing assemblies 50 and the proximal end caps 59, so that the distal ends 24 of the bar 12 extend into the second bore portions 45 of the sleeves 30. The distal bushings 76 are then inserted into the second bore portions 45 through the distal openings 33 of the sleeves 30, followed by (or concurrently with) the bearings 71 of the distal bearing assemblies 70. The fasteners 61 are connected to the projections 23 of the bar 12, and the retainers 97 are threaded into the second bore portions 45 of the sleeves 30 to engage the bearings 71. The end caps 34 are then assembled and threaded into the second bore portions 45 to complete assembly. Removal or disassembly of these components can be accomplished by reversing the steps discussed above.

Various embodiments of barbells and components thereof have been described herein, which include various components and features. In other embodiments, the barbell may be provided with any combination of such components and features. It is also understood that in other embodiments, the various devices, components, and features of the barbell described herein may be constructed with similar structural and functional elements having different configurations, including different ornamental appearances.

The barbells and components thereof described herein provide benefits and advantages over existing barbells. For example, the barbells 10 shown in FIGS. 1-20 allow extremely free and smooth rotation of the sleeves 30 (and any weights mounted thereon) relative to the bar 12, as a result of the low friction provided by the bearing assemblies 50, 70. Additionally, the components of the barbells 10 facilitate the use of bearings 51, 71, such as by isolating the bearings 51, 71 from shock and protecting the bearings 51, 71 and the bar 12 from damage, permitting looser tolerances between the bearings 51, 71 and the sleeves 30 and thereby facilitating manufacturing, and reducing noise emitted when the barbell 10 is dropped. Still other benefits and advantages are recognized by those skilled in the art.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. When used in description of a method or process, the term "providing" (or variations thereof) as used herein means generally making an article available for further actions, and does not imply that the entity "providing" the article manufactured, assembled, or otherwise produced the article. Nothing in this specification should be construed as requiring a specific three dimensional orientation of structures in order to fall within the scope of this invention, unless explicitly specified by the claims. "Integral joining technique," as used herein, means a technique for joining two pieces so that the two pieces effectively become a single, integral piece, including, but not limited to, irreversible joining techniques such as welding, brazing, soldering, or the like, where separation of the joined pieces cannot be accomplished without structural damage thereto. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. A barbell comprising:

a bar having a first end portion and a second end portion;

a first sleeve assembly comprising a first sleeve having a first axial bore with a first proximal bore portion, a first distal bore portion, and a first central bore portion extending between the first proximal bore portion and the first distal bore portion, wherein the first end portion of the bar is received through the first axial bore and extends through the first proximal bore portion and the first central bore portion to the first distal bore portion;

an inner proximal bushing received in the first proximal bore portion of the first sleeve, wherein the inner proximal bushing has an inner surface engaging the bar and an outer surface opposite the inner surface;

a proximal bearing received in the first proximal bore portion and having an inner race engaging the inner proximal bushing, an outer race positioned outward of the inner race, and a first set of roller bodies and a second set of roller bodies engaged between an outer surface of the inner race and an inner surface of the outer race, wherein the outer surface of the inner race has a first annular channel receiving the first set of roller bodies and a second annular channel receiving the second set of roller bodies, and wherein the inner surface of the outer race has a concavely curved annular channel receiving both the first and second sets of roller bodies; and an outer proximal bushing received in the first proximal bore portion of the first sleeve, wherein the outer proximal bushing has an outer surface engaging the first sleeve and an inner surface engaging the outer race of the proximal bearing.

2. The barbell of claim 1, wherein the inner proximal bushing has a first lip extending outward and engaging a proximal end of the proximal bearing and a second lip extending outward and engaging a distal end of the proximal bearing.

3. The barbell of claim 1, wherein the outer proximal bushing includes a lip extending radially inward from the outer proximal bushing and received between a distal end of the proximal bearing and a distal end of the first proximal bore portion.

4. The barbell of claim 1, further comprising a proximal end cap having a first annular groove in a radially outer surface thereof and a resilient O-ring received within the first annular groove, wherein the proximal end cap is received within the first annular groove and engages an inner surface of the first proximal bore portion to cover a proximal opening of the first proximal bore portion.

5. The barbell of claim 4, wherein the inner surface of the first proximal bore portion has a second annular groove, and the resilient O-ring is received in the second annular groove to retain the proximal end cap within the first proximal bore portion.

6. The barbell of claim 1, wherein the first set of roller bodies and the second set of roller bodies are balls, such that the proximal bearing is a ball bearing.

7. The barbell of claim 1, wherein the outer proximal bushing and the inner proximal bushing are made from a polymer material.

8. The barbell of claim 1, wherein the inner proximal bushing radially spaces the bar from the inner race of the proximal bearing, and the outer proximal bushing radially spaces the first sleeve from the outer race of the proximal bearing.

9. A barbell comprising:

a bar having a first end portion and a second end portion;

a first sleeve assembly comprising a first sleeve having a first axial bore with a first proximal bore portion, a first distal bore portion, and a first central bore portion extending between the first proximal bore portion and the first distal bore portion, wherein the first end portion of the bar is received through the first axial bore and extends through the first proximal bore portion and the first central bore portion to the first distal bore portion;

a distal bearing received in the first distal bore portion and having an inner race engaging the first end portion of the bar, an outer race positioned outward of the inner race, and a plurality of roller bodies engaged between the inner race and the outer race;

a fastener positioned in the first distal bore portion and engaging the first end portion of the bar and the inner race of the distal bearing to retain the distal bearing in connection with the bar;

a distal bushing received in the first distal bore portion of the first sleeve, wherein the distal bushing has an outer surface engaging the first sleeve and an inner surface engaging the outer race of the distal bearing; and a retainer positioned in the first distal bore portion and engaging the first sleeve and the outer race of the distal bearing to retain the distal bearing in connection with the first sleeve.

10. The barbell of claim 9, wherein the distal bushing includes a lip extending radially inward from the distal bushing and received between a front side of the distal bearing and a proximal end of the first distal bore portion.

11. The barbell of claim 9, wherein the retainer is a collar nut threadably engaging an inner surface of the first distal bore portion, wherein the first end portion of the bar passes through the collar nut.

12. The barbell of claim 9, wherein the retainer threadably engages an inner surface of the first distal bore portion.

13. The barbell of claim 9, wherein the first end portion of the bar includes a projection extending outwardly at a distal end of the bar, wherein the inner race of the distal bearing engages the projection, and the fastener threadably engages the projection.

14. The barbell of claim 9, wherein the retainer is formed of a metallic material and includes a polymeric annular bumper on a front surface thereof to engage the outer race of the distal bushing.

15. The barbell of claim 9, further comprising an end cap comprising an end cap base having a proximal portion received within the first distal bore portion of the first sleeve and a distal portion extending out of the first sleeve and forming a portion of an exterior radial surface of the barbell, the distal portion having a recess, and an end cap plate received within the recess.

16. The barbell of claim 9, wherein the distal bushing radially spaces the first sleeve from the outer race of the distal bearing.

17. A barbell comprising:

a bar having a first end portion and a second end portion;

a first sleeve assembly comprising a first sleeve having a first axial bore with a first proximal bore portion, a first distal bore portion, and a first central bore portion extending between the first proximal bore portion and the first distal bore portion, wherein the first end portion of the bar is received through the first axial bore and extends through the first proximal bore portion and the first central bore portion to the first distal bore portion;

a distal bearing received in the first distal bore portion and having an inner race engaging the first end portion of the bar, an outer race positioned outward of the inner race, and a plurality of roller bodies engaged between the inner race and the outer race; and an end cap comprising an end cap base having a proximal portion received within the first distal bore portion of the first sleeve and threadably engaged with an inner surface of the first distal bore portion, and a distal portion extending out of the first sleeve and forming a portion of an exterior radial surface of the barbell, the distal portion having a recess, and an end cap plate received within the recess.

18. The barbell of claim 17, wherein the recess in the end cap base is a circular recess, and the end cap plate is a circular plate.

19. The barbell of claim 17, further comprising a fastener extending axially with respect to the bar through the end cap plate to connect the end cap plate to the end cap base.

20. The barbell of claim 17, further comprising:

a distal bushing received in the first distal bore portion of the first sleeve, wherein the distal bushing has an outer surface engaging the first sleeve and an inner surface engaging the outer race of the distal bearing; and a retainer positioned in the first distal bore portion and engaging the first sleeve and the outer race of the distal bearing to retain the distal bearing in connection with the first sleeve, wherein the retainer is positioned between the end cap and the distal bearing.

21. The barbell of claim 17, wherein the distal portion has a larger diameter than the proximal portion and extends radially outward relative to the proximal portion.

22. The barbell of claim 17, wherein an outer radial surface of the distal portion of the end cap base is flush with an outer radial surface of the first sleeve and is positioned at a distal end of the first sleeve.

23. The barbell of claim 17, wherein the end cap plate has an outer surface, an inner surface located axially inward from the outer surface, and an outer edge extending between the inner surface and the outer surface, and wherein the end cap plate is received within the recess in the end cap base such that the inner surface faces the proximal portion of the end cap base, the outer surface faces axially outward, and a portion of the end cap base is positioned around the outer edge.

* * * * *